US010899483B2

(12) United States Patent
Takemura et al.

(10) Patent No.: US 10,899,483 B2
(45) Date of Patent: Jan. 26, 2021

(54) PAPER SHEET HANDLING APPARATUS AND PAPER SHEET HANDLING METHOD

(71) Applicant: GLORY LTD., Hyogo (JP)

(72) Inventors: Youichi Takemura, Himeji (JP); Koichi Nishida, Himeji (JP); Koichi Nabeyama, Himeji (JP)

(73) Assignee: GLORY LTD., Hyogo (JP)

( * ) Notice: Subject to any disclaimer, the term of this patent is extended or adjusted under 35 U.S.C. 154(b) by 232 days.

(21) Appl. No.: 15/954,162

(22) Filed: Apr. 16, 2018

(65) Prior Publication Data

US 2018/0305047 A1 Oct. 25, 2018

(30) Foreign Application Priority Data

Apr. 19, 2017 (JP) ..... 2017-082796

(51) Int. Cl.

| | |
|---|---|
| ***B65B 7/02*** | (2006.01) |
| ***G07D 11/00*** | (2019.01) |
| ***G07D 11/14*** | (2019.01) |
| ***G07D 11/16*** | (2019.01) |

(Continued)

(52) U.S. Cl.

CPC ..... *B65B 7/02* (2013.01); *G07D 11/0093* (2013.01); *G07D 11/12* (2019.01); *G07D 11/125* (2019.01); *G07D 11/14* (2019.01); *G07D 11/16* (2019.01); *G07D 11/20* (2019.01); *G07D 11/22* (2019.01); *B65H 2301/422548* (2013.01);

(Continued)

(58) Field of Classification Search

CPC ..... G07D 2211/00; G07D 2207/00; G07D 11/12; G07D 11/125; G07D 11/16; B65H 2301/422548; B65B 7/02

See application file for complete search history.

(56) References Cited

U.S. PATENT DOCUMENTS 9,754,436 B1 * 9/2017 Drasinover ..... G07D 11/009
2004/0264813 A1 * 12/2004 Steffens ..... B65D 27/30 383/5

(Continued)

FOREIGN PATENT DOCUMENTS

| | | |
|---|---|---|
| EP | 2 979 983 | 2/2016 |
| JP | 2012-174131 | 9/2012 |

(Continued)

OTHER PUBLICATIONS

Extended European Search Report dated Sep. 10, 2018 in related application No. 18167489.6-1009.

(Continued)

*Primary Examiner* — Robert F Long

*Assistant Examiner* — Xavier A Madison

(74) *Attorney, Agent, or Firm* — Greenblum & Bernstein, P.L.C.

(57) ABSTRACT

A paper sheet handling apparatus (for example, a banknote handling apparatus) for storing a paper sheet inside a storage bag provided with an opening includes a first bonding unit (for example, each heating member) which thermally bond and seal a portion to be a bottom part of the storage bag held by the holding unit (for example, each holding member) when the paper sheet is stored in the storage bag and a second bonding unit (for example, each holding member) which bonds and seals an opening of the storage bag held by the holding unit with a bonding material (for example, each bonding part).

15 Claims, 13 Drawing Sheets

(51) Int. Cl.

| | |
|---|---|
| ***G07D 11/20*** | (2019.01) |
| ***G07D 11/22*** | (2019.01) |
| ***G07D 11/125*** | (2019.01) |
| ***G07D 11/12*** | (2019.01) |
| *G07D 7/181* | (2016.01) |

(52) U.S. Cl.
CPC ..... *G07D 7/181* (2017.05); *G07D 2207/00* (2013.01); *G07D 2211/00* (2013.01)

(56) References Cited

U.S. PATENT DOCUMENTS

| | | | | |
|---|---|---|---|---|
| 2005/0036716 | A1* | 2/2005 | Geyer | B65D 33/18 383/5 |
| 2013/0212984 | A1* | 8/2013 | Reckin | B65D 33/34 53/469 |
| 2013/0213763 | A1* | 8/2013 | Rao | G07D 11/32 194/350 |
| 2014/0254960 | A1* | 9/2014 | Tanaike | B65D 33/1691 383/211 |
| 2016/0031574 | A1* | 2/2016 | Razzaboni | B65B 45/00 53/268 |
| 2016/0086415 | A1* | 3/2016 | Razzaboni | G07D 11/32 232/5 |

FOREIGN PATENT DOCUMENTS

| | | |
|---|---|---|
| JP | 2014-174581 | 9/2014 |
| WO | 2016/136517 | 9/2016 |

OTHER PUBLICATIONS

European Office Action in counterpart European Application No. 18 167 489.6, dated Feb. 6, 2020.
Notice of Reasons for Refusal in counterpart Japanese Application No. 2017-082796 dated Nov. 16, 2020, and English translation thereof.

* cited by examiner

PAPER SHEET HANDLING APPARATUS AND PAPER SHEET HANDLING METHOD

CROSS-REFERENCE TO RELATED APPLICATION

This application claims priority to Japanese Patent Application No. 2017-082796 filed on Apr. 19, 2017, the entire contents of which are incorporated herein by reference.

BACKGROUND OF THE INVENTION

1. Field of the Invention

The present invention relates to a paper sheet handling apparatus and a paper sheet handling method for storing paper sheets inside a storage bag provided with an opening.

2. Description of the Related Art

As a paper sheet handling apparatus for performing a depositing process of paper sheets such as banknotes and the like, there has been conventionally used one in which the paper sheets taken in a housing are stored in a storage bag such as a pouch bag and the like. Such a paper sheet handling apparatus is used as a part of a cash teller machine installed in a back office floor in a store such as a supermarket, and the cash teller machine dispenses the money as a change fund to be replenished to a cash settlement machine installed in a sales floor, and deposits the money as a sales proceeds collected from the cash settlement machine. As such a paper sheet handling apparatus, for example, one disclosed in Japanese Patent Publication JP2014-174581A, International Patent Publication WO2016/136517 and the like is known.

In the banknote handling apparatus disclosed in JP2014-174581A, a bonding part for sealing a main body of a storage bag for storing banknotes is provided on an inner surface of the storage bag near an opening thereof such that the bonding part extends along a width direction of the storage bag. On the bonding part, a release sheet for protecting the bonding part is removably pasted. Then, after mounting the storage bag, from which the release sheet has been removed, on the banknote handling apparatus and storing the banknotes in the storage bag, the opening of the storage bag can be sealed by the bonding part. In the banknote handling apparatus disclosed in WO2016/136517, there is provided a banknote storage mechanism for storing the banknotes inside the storage bag provided with the opening on one side, in a stacked state. More specifically, in the banknote storage mechanism, a pair of holding members is provided so as to be separated from each other and opposed to each other. Two opposing portions of the storage bag near the opening thereof are held by each holding member. Each holding member is provided with a heating member. Then, in the banknote storage mechanism, after a predetermined amount of banknotes are stored in a stacked state in the storage bag held by each holding member, before the storage bag is taken out from the banknote storage mechanism, when one holding member moves toward the other holding member and these holding members are in contact with each other, heat is applied to a portion of the storage bag near the opening thereof by the heating member, whereby the opening of the storage bag is heat-sealed. In addition, the banknote storage mechanism also includes a stage on which the bottom of the storage bag held by the pair of holding members is placed. Then, each time the banknote is stored in the storage bag held by the pair of holding members, the stage is gradually lowered, thereby maintaining a space for storing the banknotes inside the storage bag. Further, the stage is provided with a thermally bonding unit, and a portion near a bottom part of the storage bag is thermally bonded and sealed by the thermally bonding unit.

SUMMARY OF THE INVENTION

In the banknote handling apparatus disclosed in JP2014-174581A, since only the portion of the storage bag near the opening thereof is sealed and the portion near the bottom part of the inner surface of the storage bag is not sealed, there is a possibility that empty space may be generated inside the storage bag depend on the storage amount of the banknotes. On the other hand, in the banknote handling apparatus disclosed in WO2016/136517, since the portion near the bottom of the inner surface of the storage bag is sealed, generation of the empty space inside the storage bag can be prevented. However, since the portion near the opening of the storage bag is thermally sealed, when the opening of the storage bag is opened and then this opening is thermally sealed again, there is a problem that such an illegal act can not be determined.

The present invention has been made in view of these points, and it is an object of the present invention to provide a paper sheet handling apparatus and a paper sheet handling method capable of preventing generation of the empty space inside the storage bag and making it easy to determine that the opening of the storage bag has been illegally opened.

A paper sheet handling apparatus of the present invention for storing a paper sheet inside a storage bag provided with an opening includes: a holding unit which holds the storage bag; a first bonding unit which thermally bond and seal a portion to be a bottom part of the storage bag held by the holding unit when the paper sheet is stored in the storage bag;

and a second bonding unit which bonds and seals the opening of the storage bag held by the holding unit with a bonding material.

In the paper sheet handling apparatus of the present invention, the holding unit may include a pair of holding members for holding a portion of the storage bag near the opening thereof and at least one of the holding members is movable in a direction toward and away from the other holding member, the opening of the storage bag may be sealed by the second bonding unit when each holding member approach and the portion of the storage bag near the opening thereof may be sandwiched between the holding members.

In the paper sheet handling apparatus of the present invention, the portion to be the bottom part of the storage bag may be sealed by the first bonding unit after the opening of the storage bag is sealed by the second bonding unit.

The paper sheet handling apparatus of the present invention may further include: a placement unit that is movable in a substantially vertical direction and on which at least a part of the storage bag held by the holding unit is placed; and a driving unit which moves the placement unit in the substantially vertical direction, and the first bonding unit may be provided on the placement unit.

In this case, the paper sheet handling apparatus of the present invention may further include a control unit which controls the driving unit such that, when a sealing process for sealing the opening of the storage bag by the second bonding unit is performed, the placement unit is raised.

Further, the control unit may control the driving unit such that the placement unit is raised before the portion to be the bottom part of the storage bag is sealed by the first bonding unit.

The paper sheet handling apparatus of the present invention may further includes a temporary holding unit which temporarily hold a plurality of paper sheets which are to be stored in the storage bag in a stacked state before the plurality of paper sheets are stored in the storage bag held by the holding unit, and the control unit may control the driving unit such that the placement unit is lowered after the paper sheets held by the temporary holding unit are stored in the storage bag.

In this case, the paper sheet handling apparatus of the present invention may further include a pressing unit which pushes the paper sheets toward the storage bag when the paper sheets held by the temporary holding unit are stored in the storage bag.

In the paper sheet handling apparatus of the present invention, the storage bag may include a main body provided with the opening, a held portion provided near the opening of the main body and held by the holding unit, and a bonding part provided on an inner surface of the main body near the opening thereof to seal the main body, and the bonding material may be provided to the bonding part.

In this case, a release sheet for protecting the bonding part may be removably pasted on the bonding part.

Further, the bonding part visually may indicate that the opening of the main body has been opened when the opening is opened after sealing the opening.

Further, a plurality of bonding parts may be provided on an inner surface of the storage bag near the opening thereof.

In the paper sheet handling apparatus of the present invention, the first bonding unit may thermally bond a plurality of portions, each portion being to be the bottom part of the storage bag.

In the paper sheet handling apparatus of the present invention, a portion near the bottom part of the storage bag held by the holding unit may be fixed or pulled downward.

In this case, a weight may be hooked on a portion near the bottom of the storage bag held by the holding unit.

A paper sheet handling method of the present invention for storing a paper sheet inside a storage bag provided with an opening includes the steps of: holding the storage bag by a holding unit; sealing the opening of the storage bag held by the holding unit with a bonding material; and thermally bonding and sealing a portion to be a bottom part of the storage bag held by the holding unit when the paper sheet is stored in the storage bag.

BRIEF DESCRIPTION OF THE DRAWINGS

FIG. 5 is a perspective view showing a configuration of a storage bag to be held by each holding member of the banknote storage mechanism shown in FIG. 3 and the like.

FIG. 6 is a perspective view showing a state in which the storage bag is held by each holding member of the banknote storage mechanism shown in FIG. 3 and the like.

FIG. 7 is a perspective view showing a storage bag in which a portion near an opening thereof is sealed and a portion near a bottom thereof is thermally bonded and sealed by the banknote storage mechanism shown in FIG. 3 and the like.

FIG. 8 is a functional block diagram showing a configuration of a control system of the banknote handling apparatus shown in FIG. 2 and the like.

FIG. 9 is an explanatory diagram sequentially showing an operation of sealing the opening of the storage bag in which banknotes are stored in the banknote storage mechanism shown in FIG. 3 and the like.

FIG. 12 is another example of a configuration of a storage bag in which a portion near an opening thereof is sealed and a portion near a bottom thereof is thermally bonded by the banknote storage mechanism shown in FIG. 3 and the like.

FIG. 13 shows various aspects of pulling the storage bag held by each holding member downward in the banknote storage mechanism shown in FIG. 3 and the like.

DESCRIPTION OF THE PREFERRED EMBODIMENTS

Hereinafter, in an embodiment of a present invention, an example where a banknote handling apparatus for handling banknotes is used as a paper sheet handling apparatus according to the present invention will be described. In addition, in the present embodiment, a money handling machine in which the banknote handling apparatus and a coin handling apparatus are combined is also explained. FIGS. 1 to 10 are diagrams showing the banknote handling apparatus according to the present embodiment and the money handling machine provided with this banknote handling apparatus.

Figure 1:
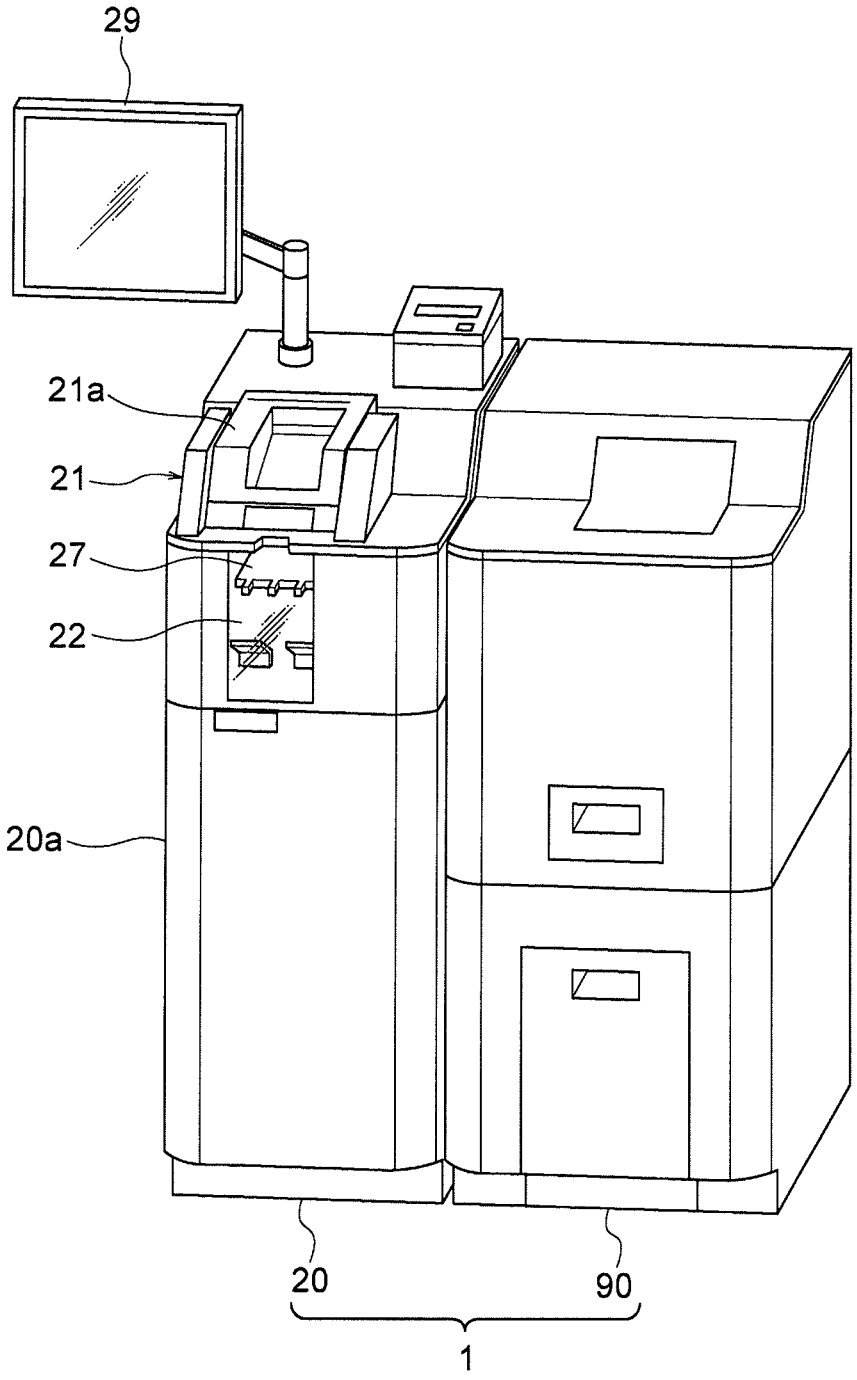
FIG. 1 is a perspective view showing an external appearance of a money handling machine according to an embodiment of a present invention.

First, a configuration of a money handling machine 1 in the present embodiment will be described with reference to FIG. 1. Generally, a store such as a supermarket is divided into a sales floor and a back office floor. The sales floor is an area where merchandises are displayed and a store clerk performs a deal with a customer who actually purchases merchandises. The back office floor is partitioned from the sales floor and is an area for managing money and merchandises. In the sales floor, one or more money settlement machines (for example, money change machines) are installed. In the back office floor, the money handling machine 1 as shown in FIG. 1 is installed. The money settlement machine is operated by a store clerk, and a settlement process between the store clerk and the customer is performed by the money settlement machine. For example, the money settlement machine deposits the money paid by the customer and dispenses a change to be paid to the customer. On the other hand, the money handling machine 1 dispenses a change fund to be replenished to the money settlement machine and deposits sales proceeds collected from the money settlement machine. By using a banknote storage cassette (more specifically, a banknote storage cassette in which a plurality of banknotes is stored and the stored banknotes therein can be fed out) that is detachable to a banknote handling apparatus (not shown) of the money settlement machine and a banknote handling apparatus 20 (to be described later) of the money handling machine 1, the banknotes are delivered between the money settlement machine and the money handling machine 1. When the banknote storage cassette is detached from the banknote handling apparatus (not shown) of the money settlement machine or the banknote handling apparatus 20 (to be described later) of the money handling machine 1, the banknotes stored in the banknote storage cassette can not be taken out.

As shown in FIG. 1, the money handling machine 1 installed in the back office floor includes the banknote handling apparatus 20 and a coin handling apparatus 90. The banknote handling apparatus 20 dispenses the banknotes to be replenished to the money settlement machine installed in the sales floor and deposits the banknotes collected from the money settlement machine. The coin handling apparatus 90 dispenses the coins to be replenished to the money settlement machine installed in the sales floor and deposits the coins collected from the money settlement machine.

Next, the configuration of the banknote handling apparatus 20 will be described with reference to FIGS. 1 and 2. A side surface on a right side of a housing 20*a* (to be described later) in FIG. 2 is a front side of the banknote handling apparatus 20 (that is, a front side when the banknote handling apparatus 20 is viewed from the front as shown in FIG. 1), and a left direction in FIG. 2 is a depth direction of the housing 20*a*.

As shown in FIG. 1, the banknote handling apparatus 20 includes the housing 20*a*, an inlet unit 21, an ejecting unit 22, and an operation/display unit 29. On the inlet unit 21, a banknote receiving device 21*a* is detachably mounted. The banknote receiving device 21*a* receives the banknotes from the outside of the banknote handling apparatus 20 and feeds out the received banknotes into the housing 20*a* one by one by a banknote feeding mechanism 21*b*. Such a banknote receiving device 21*a* is used when an operator (that is, the store clerk) manually deposits the banknotes to the banknote handling apparatus 20. In addition, in place of the banknote receiving device 21*a*, the banknote storage cassette described above can be mounted on the inlet unit 21. In this case, when the banknote storage cassette is mounted on the inlet unit 21, the banknotes stored in the banknote storage cassette are fed out one by one to the inside of the housing 20*a* by a feeding mechanism provided inside the banknote storage cassette. The banknotes fed out from storage/feeding units 25 (to be described later) are accumulated in the ejecting unit 22 in a stacked state. The banknotes accumulated in the ejecting unit 22 can be accessed from the outside of the housing 20*a*.

The operation/display unit 29 displays various information such as a storage condition of the banknotes and coins in the money handling machine 1, and the like. Further, the operation/display unit 29 is configured such that the operator can input data. The operation/display unit 29 is constituted by, for example, a touch-panel-type display and the like. The operation/display unit 29 is provided in either the banknote handling apparatus 20 or the coin handling apparatus 90, and is used in common for displaying information of both the banknote handling apparatus 20 and the coin handling apparatus 90.

Figure 2:
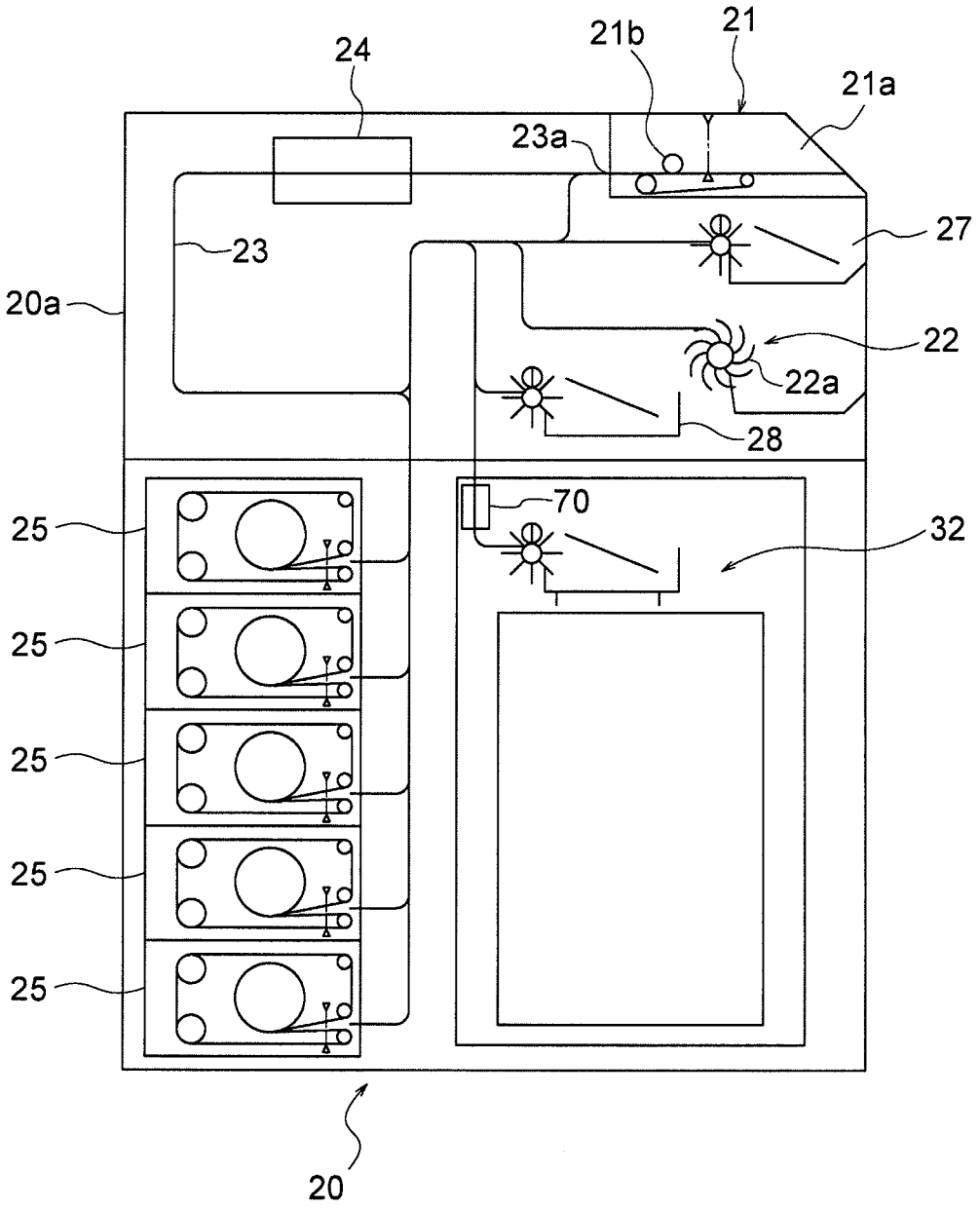
FIG. 2 is a side view showing an internal configuration of a banknote handling apparatus in the money handling machine shown in FIG. 1.

As shown in FIG. 2, inside the housing 20*a* of the banknote handling apparatus 20, there is provided a transporting unit 23 for transporting the banknotes one by one. The above described inlet unit 21 is connected to an end portion 23*a* of the transporting unit 23. When the banknote receiving device 21*a* is mounted on the inlet unit 21, the banknotes fed out from the banknote receiving device 21*a* are transported by the transporting unit 23 via the end portion 23*a* of the transporting unit 23. As shown in FIG. 2, a recognition unit 24 is provided to the transporting unit 23, and a denomination, fitness, authenticity, and the like of each banknote transported by the transporting unit 23 is recognized by the recognition unit 24. Specifically, the recognition unit 24 includes an image sensor, magnetic sensor, thickness sensor, and the like. The image sensor images the banknotes transported by the transporting unit 23 and the denomination and the like of each of the banknotes is recognized based on each banknote image captured by the image sensor.

As shown in FIG. 2, the banknote handling apparatus 20 is provided with an external rejecting unit 27 and an internal rejecting unit 28, respectively. To the external rejecting unit 27, the banknote recognized as not a normal banknote, of the banknotes put into the housing 20*a* by the inlet unit 21, is sent from the transporting unit 23 as a reject banknote. The reject banknote is ejected to the outside of the banknote handling apparatus 20 by the external rejecting unit 27. On the other hand, to the internal rejecting unit 28, the reject banknote that can not be ejected to the outside of the banknote handling apparatus 20 is sent from the transporting unit 23 and the reject banknote is stored in the internal rejecting unit 28. An operator such as the store clerk without an administrative authority can not take out the banknotes stored in the internal rejecting unit 28.

A plurality of storage/feeding units 25 is provided inside the housing 20*a*, and each storage/feeding unit 25 is connected to the transporting unit 23. Each storage/feeding unit 25 stores the banknotes by denomination. More specifically, based on the recognition result by the recognition unit 24, the banknotes fed out from the inlet unit 21 to the transporting unit 23 are sent to each storage/feeding unit 25 by the transporting unit 23 by denomination. In addition, each storage/feeding unit 25 can feed out the banknotes stored therein one by one to the transporting unit 23. More specifically, a winding-type banknote storage/feeding unit is used as each storage/feeding unit 25. The winding-type banknote storage/feeding unit has a substantially cylindrical drum which rotates around a rotation axis, and one end of a strip-shaped winding member for winding a plurality of banknotes one by one is connected to an outer peripheral surface of the drum, for example. When the banknotes are wound on the drum by the strip-shaped winding member, the banknotes are stored in the drum. In addition, as the strip-shaped winding member is rewound from the drum, the stored banknotes are fed out from the drum.

Figure 5:
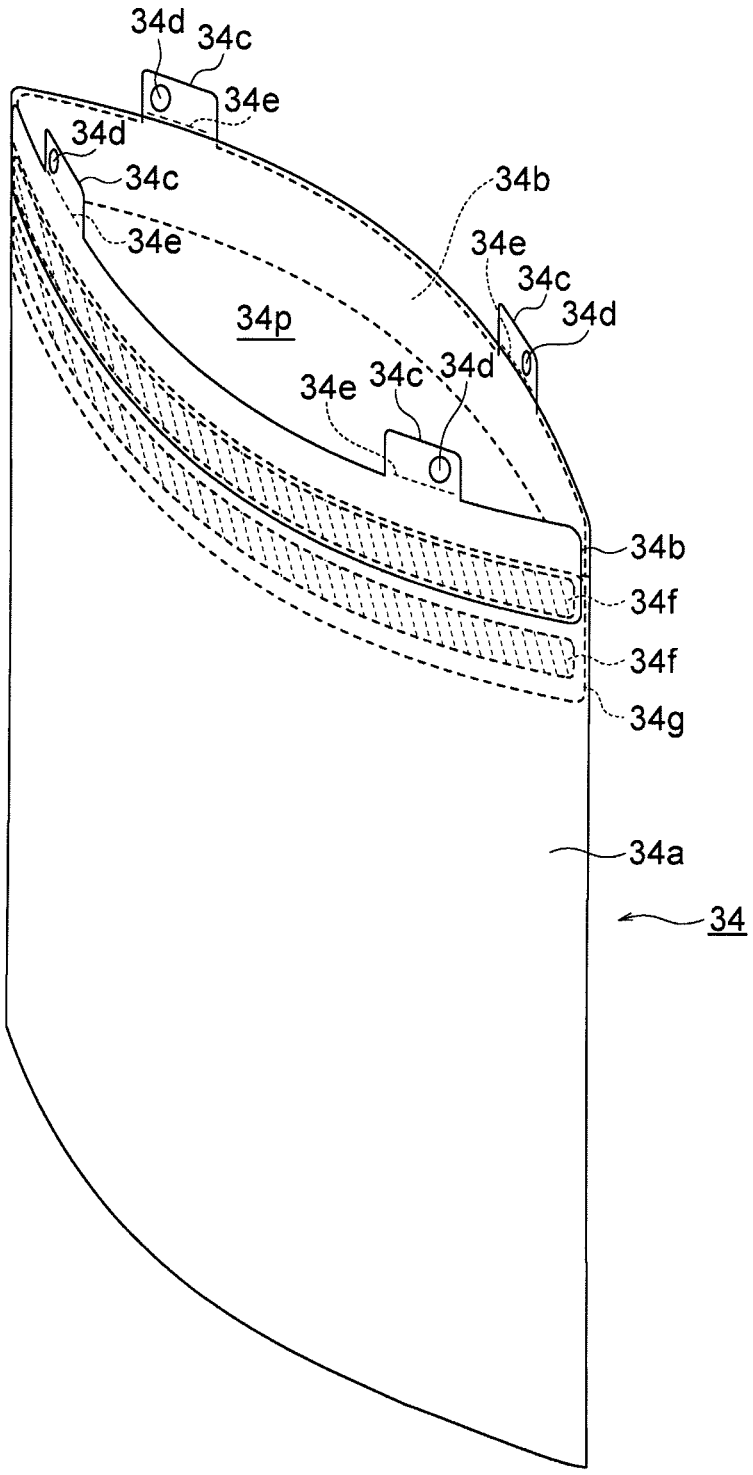

In the banknote handling apparatus 20 according to the present embodiment, a banknote storage mechanism 32 (see FIG. 2) is provided inside the housing 20*a*. On the banknote storage mechanism 32, a storage bag 34 for storing the banknotes can be detachably mounted. The banknotes sent from the storage/feeding unit 25 to the banknote storage mechanism 32 via the transporting unit 23 are stored in the storage bag 34 mounted on the banknote storage mechanism 32. The banknotes may be stored in the storage bag 34 in a state where they are not aligned. However, in the present embodiment, a plurality of banknotes is stored in the storage bag 34 in a stacked state. In such a case, it is possible to store a larger number of banknotes in the storage bag 34. The storage bag 34 for storing the banknotes is, for example, a bag shape or a tubular shape made of polyethylene. An opening 34*p* (see FIG. 5) for inserting and withdrawing the banknotes is provided at the top of the storage bag 34. In the present embodiment, the bag-shaped storage bag 34 will be described in more detail with reference to FIGS. 5 and 7. As shown in FIG. 5, the storage bag 34 includes a main body 34*a* provided with an opening 34*p* at the top. A mounting tab 34*b* is attached to a portion near the opening 34*p* on one surface of this main body 34*a*. The mounting tab 34*b* is also attached to a portion near the opening 34*p* on the other surface of the main body 34*a*. Each of the mounting tabs 34*b* is provided with two ear portions 34*c* protruding upward from the edge of the opening 34*p* in the main body 34*a*. An opening 34*d* for attachment is formed in each ear portion 34*c*. Each ear portion 34*c* is provided with a perforation 34*e*, and each ear portion 34*c* can be folded along each perforation 34*e*.

As shown in FIG. 5, near the mounting tab 34*b* on one inner surface of the main body 34*a*, an elongated bonding part 34*f* is provided in a transverse direction (that is, in a width direction of the storage bag 34) for sealing the opening 34*p* of the storage bag 34. A bonding material is applied to the bonding part 34*f*. Although only one bonding part 34*f* may be provided, a plurality of bonding parts 34*f* may be provided in order to more firmly seal the opening 34*p* of the storage bag 34. In the present embodiment, two bonding parts 34*f* are provided. In addition, a single release sheet 34*g* is removably pasted on these bonding parts 34*f* so as to protect the two bonding parts 34*f*. By peeling off such release sheet 34*g*, each bonding part 34*f* can be exposed. In the present embodiment, a security seal may be used as each of the bonding parts 34*f* protected by the release sheet 34*g*. In this case, the bonding part 34*f* as the security seal visually indicates that the opening 34*p* has been opened when the opening 34*p* of the storage bag 34 is opened after the opening 34*p* is sealed. For example, when the opening 34*p* of the storage bag 34 is opened, the letter "opened" appears on the bonding part 34*f*.

The storage bag 34 of the present embodiment is formed by overlapping two films of substantially rectangular shape and then thermally bonding and sealing portions near both side edges and a bottom part (that is, portions denoted by reference numerals 34*i* in FIG. 7) of the overlapped two films. The portions of the storage bag 34 other than the portion near the opening 34*p* is formed of a material that can be thermally bonded and sealed by each heating member 42 to be described later. In addition, the storage bag 34 is provided with a plurality of small air vent holes.

Note that the banknotes of denominations not assigned to each storage/feeding unit 25 and the overflow banknotes that can not be stored in each storage/feeding unit 25 because the storage/feeding unit 25 of the corresponding denomination is in a full state are also stored in the storage bag 34. When the storage bag 34 in which the banknotes are stored is taken out from the banknote storage mechanism 32, the banknotes stored in the storage bag 34 are collected from the banknote handling apparatus 20 together with the storage bag 34.

Figure 3:
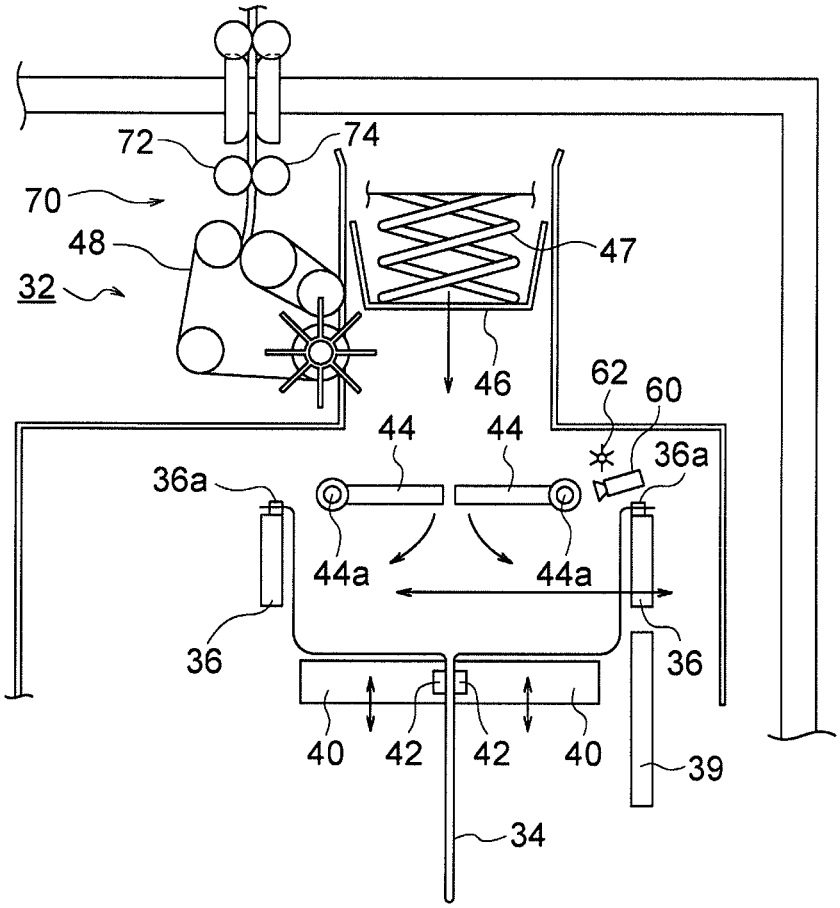
FIG. 3 is a side view showing a detail of a configuration of a banknote storage mechanism in the banknote handling apparatus shown in FIG. 2.
Figure 4:
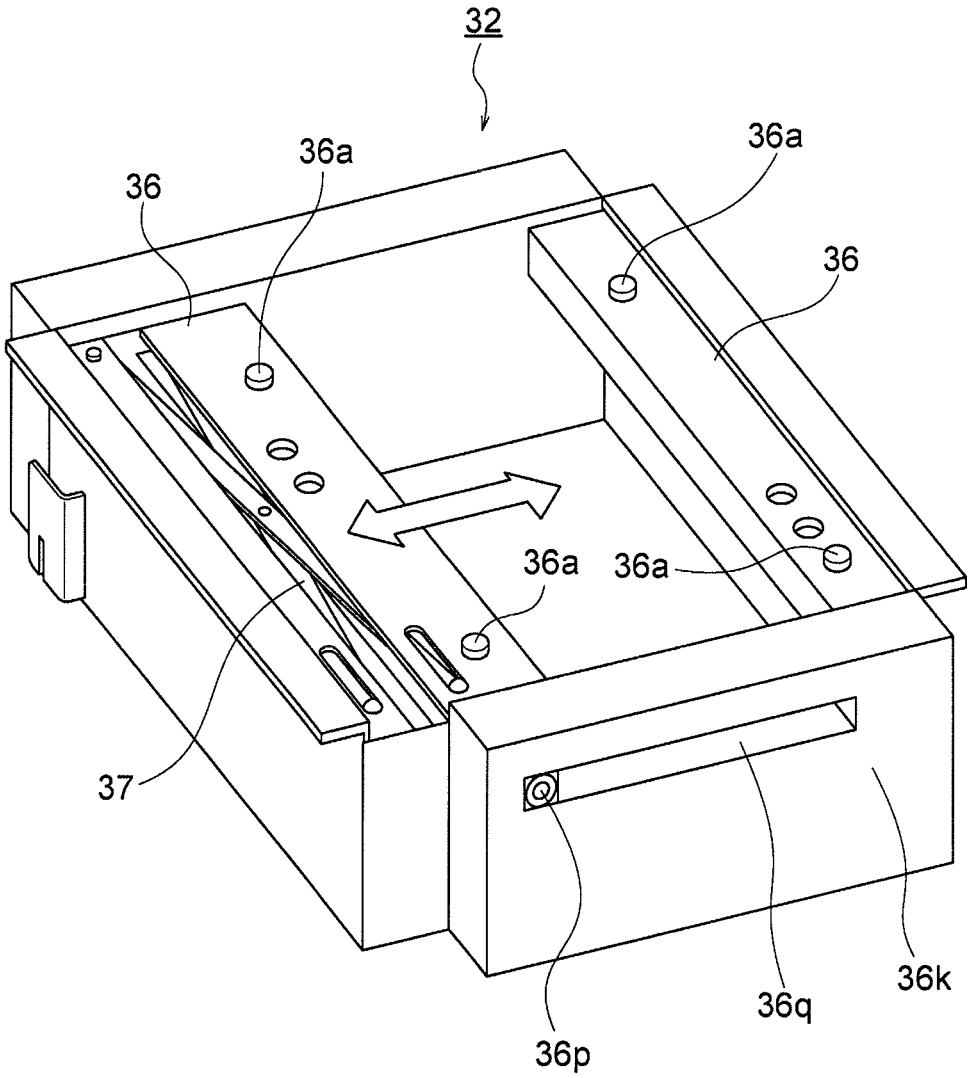
FIG. 4 is a perspective view showing a configuration of a pair of holding members and the like of the banknote storage mechanism shown in FIG. 3.
Figure 6:
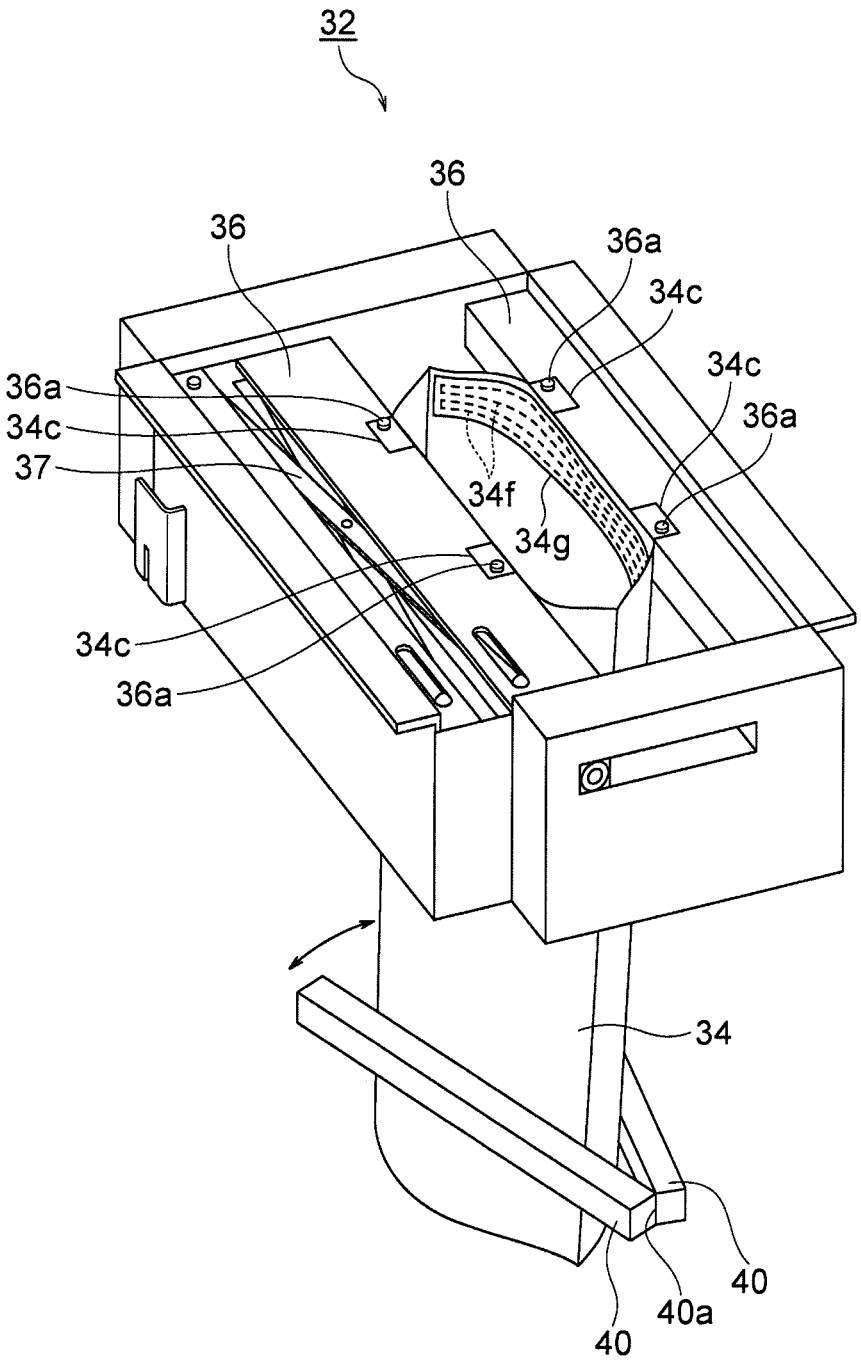

Next, details of the configuration of the banknote storage mechanism 32 in the banknote handling apparatus 20 will be described with reference to FIGS. 3, 4 and 6. FIG. 3 is a side view showing details of the configuration of the banknote storage mechanism 32, and FIG. 4 is a perspective view showing a configuration of a pair of holding members 36 and the like in the banknote storage mechanism 32 shown in FIG. 3. FIG. 6 is a perspective view showing a state in which the storage bag 34 is held by each holding member 36 of the banknote storage mechanism 32 shown in FIG. 3 and the like.

In the banknote storage mechanism 32 of the present embodiment, as shown in FIGS. 2 and 3, a banknote introducing unit 70 is provided on an inlet side of the banknote storage mechanism 32. More specifically, as shown in FIG. 3, the banknote introducing unit 70 has a pair of rollers 72, 74. The banknotes to be sent from the transporting unit 23 to the banknote storage mechanism 32 are guided to the banknote storage mechanism 32 by passing through a nip formed between the pair of rollers 72, 74. The banknote introducing unit 70 may function as a warp correcting mechanism for correcting a warp of each of the banknotes sent from the transporting unit 23 to the banknote storage mechanism 32. More specifically, a groove portion may be provided near a center of the roller 72 in a width direction thereof, and the roller 74 is arranged to enter the groove portion of the roller 72. As a result, a part of each of the banknotes passing through the banknote introducing unit 70 can be pushed into the groove of the roller 72 by the roller 74. In this manner, a tendency such as a fold that is different from the warp of the banknote can be applied to the banknote fed out from each storage/feeding unit 25 to the transporting unit 23, and therefore it is possible to correct the warp of banknote.

As shown in FIG. 3, a banknote sending unit 48 is a combination of roller and belt. The banknote sending unit 48 sends the banknotes introduced from the transporting unit 23 by the banknote introducing unit 70 onto a temporary holding unit 44 one by one and then stacks them on the temporary holding unit 44. The temporary holding unit 44 holds a plurality of banknotes in a stacked state. The temporary holding unit 44 is composed of a pair of left and right, and each temporary holding unit 44 can be rotated downward (that is, in a direction of an arrow in FIG. 3) around an axis 44*a* provided at a proximal end portion thereof.

As shown in FIG. 3 and the like, the banknote storage mechanism 32 has a holding unit. The holding unit may hold the storage bag 34 so that the storage bag 34 is in a posture capable of storing the banknotes. It is preferable that the holding unit holds the storage bag 34 with the opening 34*p* of the storage bag 34 opened. In the present embodiment, as the holding unit, a pair of holding members 36 is provided so as to be separated from each other and opposed to each other, and each portion of the storage bag 34 near the opening 34*p* thereof is held by each holding member 36. One holding member 36 (specifically, the holding member 36 on the left side in FIG. 3, for example) is fixed in its position, and the other holding member 36 (specifically, the holding member 36 on the right side in FIG. 3, for example) can move toward the position-fixed holding member 36. More specifically, as shown in FIG. 4, a pantograph 37 is provided to one of the pair of right and left holding members 36. One holding member 36 is moved toward the other holding member 36 by the pantograph 37 so that these holding members 36 come into contact with each other. More specifically, a guide pin 36*p* is provided at an end portion of one holding member 36. A linear long hole 36*q* for guiding the guide pin 36*p* is provided on a frame 36*k* that supports each holding member 36. Note that the long hole 36*q* is provided so as to extend in a horizontal direction in the frame 36*k*. When the pantograph 37 extends, the guide pin 36*p* provided on one holding member 36 is guided along the long hole 36*q*, whereby this one holding member 36 is moved toward the other holding member 36. As a result, a surface of one holding member 36 comes into contact with a surface of the other holding member 36. In addition, in the case where each bonding part 34*f* is exposed as the release sheet 34*g* is peeled off in the storage bag 34, when each holding member 36 comes into contact with each other, each bonding part 34*f* provided on one inner surface of the storage bag 34 bonds to the other inner surface of the storage bag 34, whereby the opening 34*p* of the storage bag 34 is sealed. In the banknote storage mechanism 32, instead of moving one holding member 36 of the pair of holding members 36 toward the other holding member 36, both holding members 36 may be moved toward the other holding member 36 to a central position so that these holding members 36 come into contact with each other in the central position.

As shown in FIG. 4, two pins 36*a* are provided on an upper surface of each of the pair of right and left holding members 36. As described above, the mounting tab 34*b* provided with two ear portions 34*c* each having the opening 34*d* is attached at the position near the opening 34*p* of the storage bag 34 (that is, the upper part of the storage bag 34) to be held by each holding member 36. When the storage bag 34 is held by each holding member 36, after each ear portion 34*c* is folded along the perforation 34*e*, each pin 36*a* of each holding member 36 passes through each opening 34*b* provided in each ear portion 34*c* of the storage bag 34. As a result, each ear portion 34*c* is held by each holding member 36.

As shown in FIG. 3, in the banknote storage mechanism 32, there is provided a stage 40 (placement unit) on which at least a part of the storage bag 34 held by each holding member 36 is placed. The stage 40 may be one on which at least a part of the storage bag 34 is placed and movable in the vertical direction. In the present embodiment, the stage 40 is composed of a pair of right and left, and each stage 40 is movable in the vertical direction and the horizontal direction in FIG. 3. More specifically, as shown in FIG. 6 and the like, the pair of stages 40 are connected to each other by a hinge part 40*a* provided at an end portion of each stage 40. Each stage 40 can swing in a direction of an arrow in FIG. 6 around the hinge part 40*a* along a horizontal plane. When each stage 40 opens, a gap is formed between these stages 40. Then, a part of the storage bag 34 held by the holding member 36 can extend downward from each stage 40 through this gap. Each stage 40 is driven by a stage driving unit 41 (see FIG. 8) such as an electric actuator. More specifically, each stage 40 is moved in the vertical direction in FIG. 3 by the stage driving unit 41 and is opened and closed about the hinge part 40*a* along the horizontal plane. Note that the pair of stages 40 are connected to each other by the hinge part 40*a* so as to be opened and closed about the hinge part 40*a* as described above, in FIGS. 3, 9, 10 and the like, for the sake of convenience, opening and closing movements of each stage 40 about the hinge part 40*a* are indicated by the movement in the lateral direction of each stage 40.

Each stage 40 is provided with a heating member 42. Then, before the storage bag 34 is taken out from the banknote storage mechanism 32, when one stage 40 (for example, the stage 40 on the right side in FIG. 3) is moved toward the other stage 40 (for example, the stage 40 on the left side in FIG. 3) and these stages 40 are in contact with each other, heat is applied from each heating member 42 to a portion to be a bottom part of the storage bag 34 when the banknotes are stored therein, so that the bottom portion of the storage bag 34 is thermally bonded and sealed. Note that the position of the storage bag 34 which is thermally bonded and sealed by each heating member 42 varies depending on the storage amount of the banknotes in the storage bag 34.

In the present embodiment, each heating member 42 functions as a first bonding unit for thermally bonding and sealing the portion to be the bottom part of the storage bag 34 held by each holding member 36 when the banknotes are stored in the storage bag 34. In the present embodiment, each heating member 42 is provided in each stage 40, but the stage 40 and the first bonding unit may be separately provided. In addition, each holding member 36 functions as a second bonding unit for bonding and sealing the opening 34*p* of the storage bag 34 held by each holding member 36 with the bonding material. In other words, each holding member 36 functions as both the holding unit for holding the portion of the storage bag 34 near the opening 34*p* thereof, and the second bonding unit for sealing the opening 34*p* of the storage bag 34 held by the holding unit with the bonding material. It should be noted that the present embodiment is not limited to such an aspect. In another aspect of the present embodiment, the holding unit for holding the portion of the storage bag 34 near the opening 34*p* thereof and the second bonding unit for sealing the opening 34*p* of the storage bag 34 held by the holding unit with the bonding material may be separately provided.

As shown in FIG. 3, a pusher plate 46 (pressing unit) is provided above the pair of temporary holding units 44. The pusher plate 46 is provided with a pantograph 47, and as the pantograph 47 extends downward, the pusher plate 46 can move downward from the state shown in FIG. 3. As the pusher plate 46 moves downward from the state shown in FIG. 3, when the banknotes temporarily held on each temporary holding unit 44 are stored in the storage bag 34, it is possible to push the banknotes remaining on each temporary holding unit 44 toward the storage bag 34 by the pusher plate 46. In the case where the wind-up type banknote storage/feeding unit is used as the storage/feeding unit 25, the banknotes stored in the storage/feeding unit 25 may be warped. If such a banknote is stored in the storage bag 34, the end of the banknote may reach the opening 34*p* of the storage bag 34, and when the opening 34*p* is bonded by the bonding material, the banknote that reaches the opening 34*p* of the storage bag 34 may also be bonded together. On the other hand, by pushing the banknotes stored in the storage bag 34 with the pusher plate 46, it is possible to prevent such a problem.

As shown in FIG. 3, a biasing lever 39 is provided below the right holding member 36 of the pair of holding members 36. By the biasing lever 39, the banknotes stored in the storage bag 34 held by the pair of holding members 36 can be gathered to one side (specifically, to the left side in FIG. 3) within the storage bag 34. More specifically, the biasing lever 39 can be moved to the left side from the state shown in FIG. 3 by a biasing lever driving unit 39*a* (see FIG. 8) composed of a pantograph, an electric actuator and the like.

In the banknote storage mechanism 32, in the vicinity of the opening 34*p* of the storage bag 34 held by the pair of holding members 36, there is provided an imaging unit 60 such as a camera or video camera for imaging the inner surface of the storage bag 34. A mark is provided on the inner surface of the storage bag 34 held by each holding member 36 near the opening 34*p* of the storage bag 34, and this mark is imaged by the imaging unit 60. In the vicinity of the imaging unit 60, there is provided a light source 62 for irradiating light onto the inner surface of the storage bag 34 held by each holding member 36. By illuminating the inner surface of the storage bag 34 with such a light source 62, the imaging unit 60 can sharply image the mark formed near the opening 34*p* on the inner surface of the storage bag 34.

Figure 8:
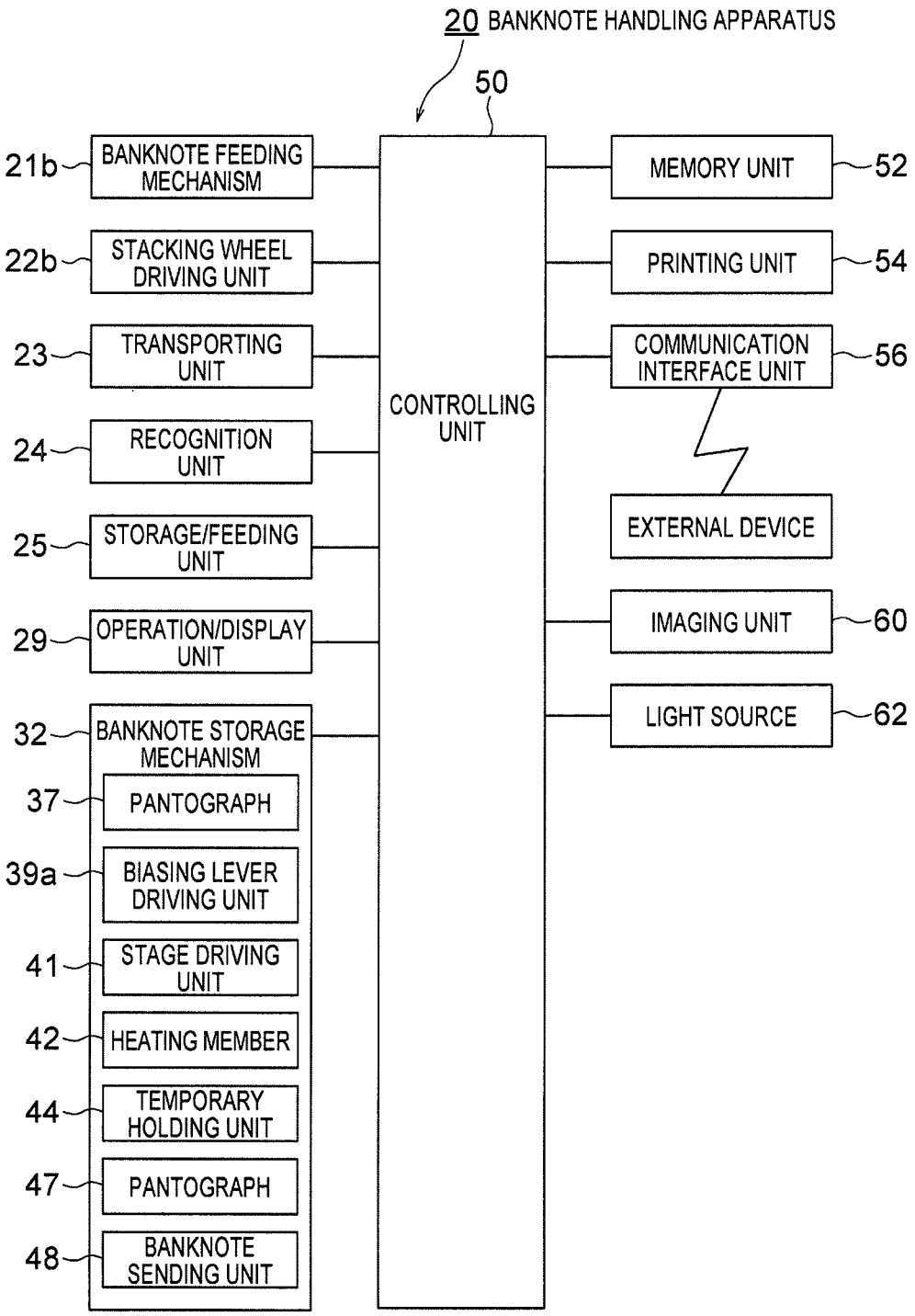

The banknote handling apparatus 20 according to the present embodiment is provided with a controlling unit 50 for controlling each component of the banknote handling apparatus 20. More specifically, as shown in FIG. 8, to the controlling unit 50, the banknote feeding mechanism 21*b* provided in the banknote receiving device 21*a* mounted on the inlet unit 21, a stacking wheel driving unit 22*b* for driving a stacking wheel 22*a* provided in the ejecting unit 22, the transporting unit 23, the recognition unit 24, each storage/feeding unit 25, the operation/display unit 29, the banknote storage mechanism 32 (specifically, the pantograph 37, the biasing lever driving unit 39*a*, the stage driving unit 41, each heating member 42, each temporary holding unit 44, the pantograph 47 and the banknote sending unit 48), a memory unit 52, a printing unit 54, a communication interface unit 56, the imaging unit 60, the light source 62, and the like are respectively connected. Then, a signal related to a recognition result and detection result of the banknote by the recognition unit 24 and the image taken by the imaging unit 60 are sent to the controlling unit 50. Further, the controlling unit 50 controls the operation of these components by sending a command signal to each component of the banknote handling apparatus 20.

The memory unit 52 stores a process history such as a deposit process of the banknotes in the banknote handling apparatus 20 and information on the amount of the banknotes stored in each storage/feeding unit 25 and storage bag 34. The printing unit 54 prints on a receipt and the like the process history such as the deposit process of the banknotes in the banknote handling apparatus 20 and the information on the amount of the banknotes stored in each storage/feeding unit 25 and storage bag 34. The controlling unit 50 can transmit and receive signals to and from an external device (specifically, for example, a higher-ranking terminal) provided separately from the banknote handling apparatus 20 according to the present embodiment via the communication interface unit 56. More specifically, the controlling unit 50 can transmit the information stored in the memory unit 52 to the external device provided separately from the banknote handling apparatus 20 via the communication interface unit 56. For example, when a security guard and the like of a security company collects the banknotes together with the storage bag 34, information on the collected banknotes is transmitted to the computer of the security company and the like by the communication interface unit 56.

Next, in the banknote storage mechanism 32, the operation of storing the banknotes, sent from the transporting unit 23 to the banknote storage mechanism 32, into the storage bag 34 held by the pair of holding members 36 will be briefly described.

The banknotes sent from the transporting unit 23 to the banknote storage mechanism 32 are sent one by one onto the pair of temporary holding units 44 by the banknote sending unit 48 and then accumulated in a stacked state on these temporary holding units 44. When a predetermined number of banknotes are accumulated on the temporary holding units 44, each temporary holding unit 44 rotates downward (that is, in the direction of the arrow in FIG. 3) about the axis 44*a* provided at the proximal end portion thereof. As a result, the banknotes accumulated on the temporary holding units 44 fall from these temporary holding units 44 due to their own weight and are stored in a stacked state in the storage bag 34. In addition, when the banknotes fall from the temporary holding units 44 and are stored in the storage bag 34, each stage 40 is moved downward by the stage driving unit 41, and then storage space of the banknotes to be sent from the temporary holding units 44 to the storage bag 34 is formed inside the storage bag 34. In the present embodiment, the controlling unit 50 controls the pantograph 47 such that, when the banknotes are sent into the storage bag 34 held by each holding member 36 and stored in the storage bag 34, the banknotes held onto the temporary holding unit 44 are pushed into the storage bag 34 by the pusher plate 46. As a result, even when the banknotes remain on the temporary holding units 44, such remaining banknotes can be dropped from the temporary holding units 44 and stored in the storage bag 34.

When the banknotes are stored in the storage bag 34 held by each holding member 36, the mark provided on the inner surface of the storage bag 34 near the opening 34*p* thereof is imaged by the imaging unit 60 each time. When a predetermined amount of the banknotes are stored in the storage bag 34 and the mark is obstructed by the banknotes stored in the storage bag 34 in the image taken by the imaging unit 60 and this mark is no longer captured by the imaging unit 60, the controlling unit 50 determines that the storage state of the banknotes in the storage bag 34 is abnormal. The abnormal storage state is a state in which some banknote is stored in a standing state near the opening of the storage bag 34 or some banknote stored in the storage bag 34 is bent.

As described above, since the storage abnormality can be detected based on the image captured by the imaging unit 60, when the holding member 36 on the right side in FIG. 3 moves toward the holding member 36 on the left side and the opening 34*p* of the storage bag 34 is sealed by the bonding part 34*f* as will be described later, it is possible to inhibit the banknotes stored in the storage bag 34 from being sandwiched between the holding members 36 and causing an unsealed portion to be generated at the opening 34*p* of the storage bag 34. It should be noted that the abnormal storage state may be determined by the controlling unit 50 based on the pressing movement of the temporary holding unit 44 by the pusher plate 46. More specifically, in the abnormal storage state, some banknotes stored in the storage bag 34 will be present in a movable range of the temporary holding unit 44 (see the arrow in FIG. 3). In this case, when the temporary holding unit 44 is pushed into the storage bag 34 by the pusher plate 46, the end portion of the temporary holding unit 44 comes into contact with the banknotes stored in the storage bag 34. Therefore, it is impossible to push the temporary holding unit 44 further into the storage bag 34 any more. Based on this, it is possible to judge the abnormal storage state occurs. In addition, even in the case where the temporary holding units 44 are provided above the position shown in FIG. 3 and the banknotes stored in the storage bag 34 are not present in the movable range of the temporary holding unit 44, it may be arranged that the abnormal storage state is detected by the controlling unit 50 based on the pushing movement of the pusher plate 46. More specifically, in the abnormal storage state, when pushing the banknotes held on the temporary holding unit 44 into the storage bag 34 by the pusher plate 46, the distance that the pusher plate 46 can move toward the storage bag 34 is shorter than when the storage state is normal. Based on this, it is possible to judge the abnormal storage state occurs.

Figure 9:
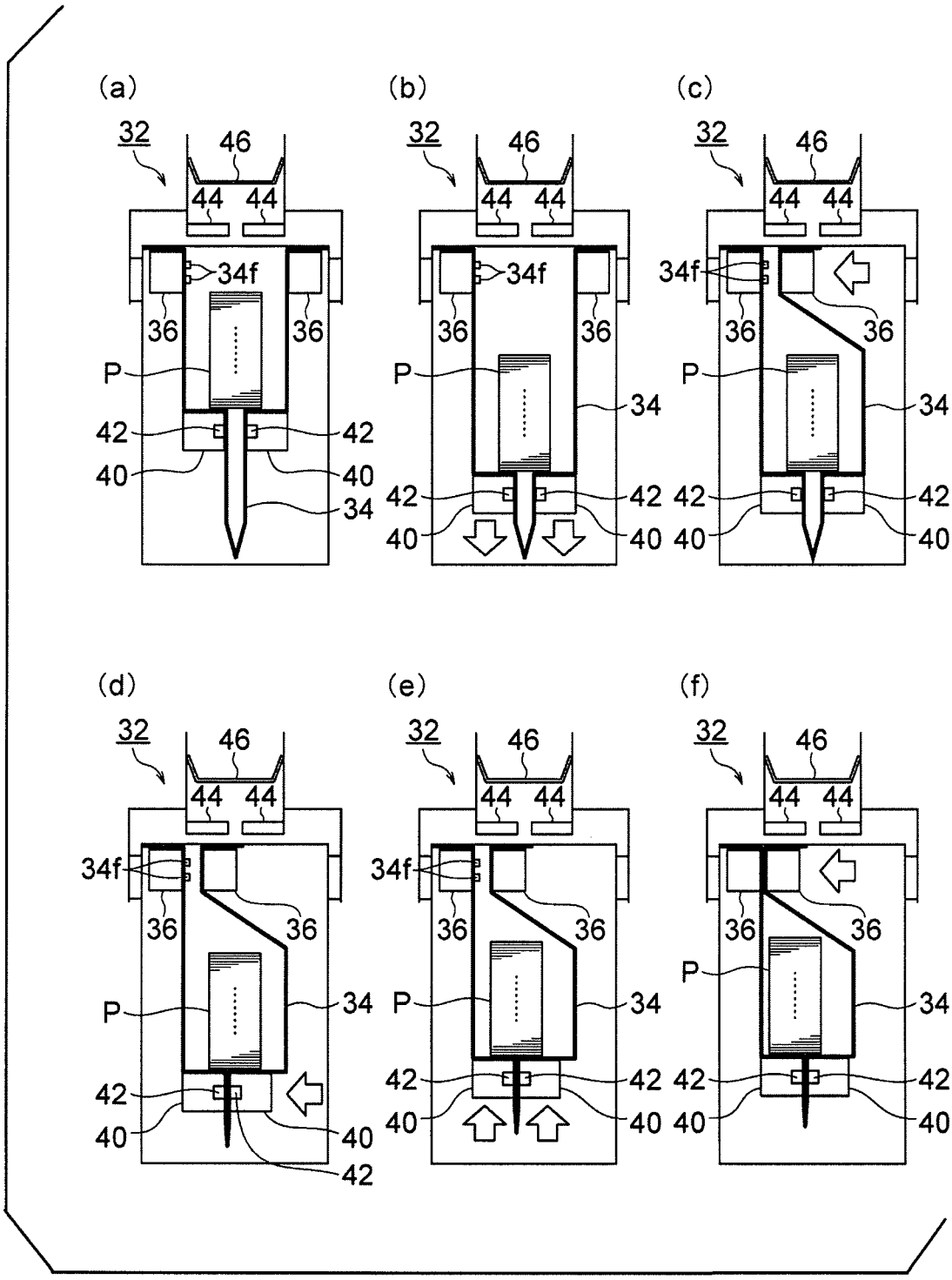
Figure 10:
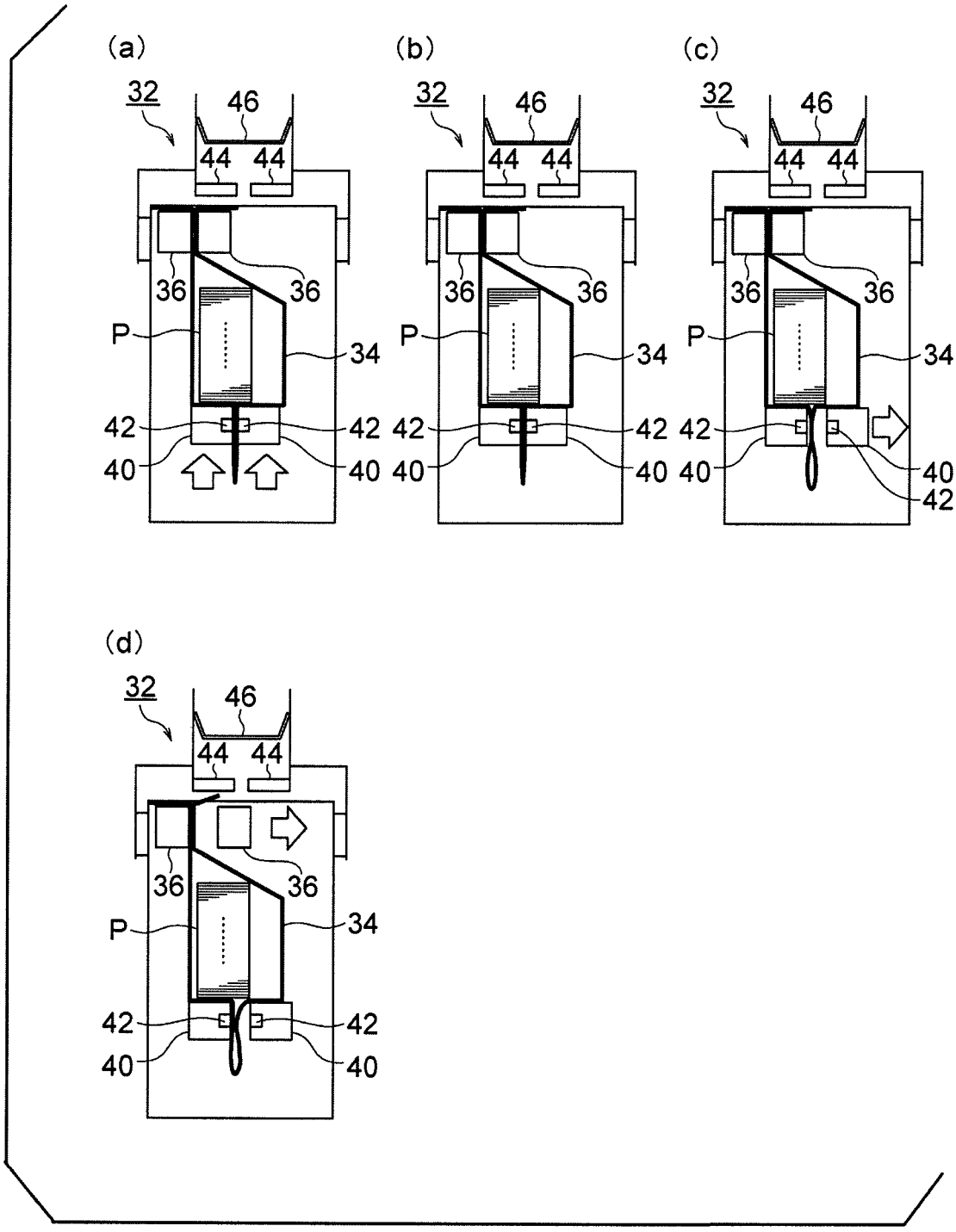
FIG. 10 shows the operation of sealing the opening of the storage bag in which the banknotes are stored in the banknote storage mechanism shown in FIG. 3 and the like following the state shown in (f) of FIG. 9.

When a sealing process is started, the opening 34*p* of the storage bag 34 held by each holding member 36 is sealed. The sealing process is started based on an instruction input from the operation/display unit 29. Note that the sealing process may be started based on an instruction input from the external device. Alternatively, the sealing process may be started when the amount of banknotes stored in the storage bag 34 reaches a predetermined amount. The predetermined amount can be a predetermined number of banknotes or a predetermined amount of money. The predetermined number of banknotes may be the number of banknotes in which the storage bag 34 is in a full state or a near-full state. In addition, the sealing process may be started based on the time. When the sealing process is started based on the input instruction or the time, as a process before the sealing process is started, a collecting process such that the banknotes stored in the storage/feeding units 25 are transported to the banknote storage mechanism 32 and stored in the storage bag 34 may be performed. In the collecting process, the banknotes stored in the storage/feeding units 25 may be collected as much as possible. In this case, it is preferable to set an upper limit on the number or amount of banknotes that can be stored in the storage bag 34. Further, the collecting process may be performed such that the number or amount of banknotes stored in the storage bag 34 becomes a predetermined value. Alternatively, in the collecting process, the banknotes of a predetermined number or a predetermined amount may be left in the storage/feeding units 25 and the other banknotes may be collected. After the opening 34*p* of the storage bag 34 is sealed, the storage bag 34 is taken out from the banknote storage mechanism 32 by the operator's hand. Details of the operation of the sealing process such that the opening 34*p* of the storage bag 34 held by each holding member 36 is sealed will be described below with reference to FIGS. 9 and 10. The operation of the sealing process as described below is performed by the controlling unit 50 controlling each component of the banknote storage mechanism 32. In FIGS. 9 and 10, the banknotes stored in the storage bag 34 are indicated by reference numeral P.

As shown in FIG. 9 (*a*), when it is judged that the amount of the banknotes stored in the storage bag 34 has reached a predetermined amount set in advance, a guidance screen prompting the operator to take out the storage bag 34 from the banknote storage mechanism 32 is displayed on the operation/display unit 29. Then, when the operator inputs the command to start the sealing process to the controlling unit 50 by the operation/display unit 29, the following sealing process is started.

When the sealing process for sealing the opening 34*p* of the storage bag 34 held by each holding member 36 is started, each stage 40 is lowered by a predetermined distance by the stage driving unit 41 (see an arrow in FIG. 9 (*b*)). This makes it possible to make a distance between the upper end of the banknotes stored in the storage bag 34 and each bonding part 34*f* of the storage bag 34 held by each holding member 36 in the vertical direction larger than a predetermined size. Therefore, when the holding members 36 approach and the portion of the storage bag 34 near the opening 34*p* thereof is sandwiched between the holding members 36, as described later, it is possible to prevent some banknote stored in the storage bag 34 from being sandwiched between the holding members 36 and contacting the bonding part 34*f* so that some banknote is bonded to the bonding part 34*f*.

The controlling unit 50 reduces the distance between the holding members 36 to such an extent that the storage bag 34 is not sandwiched between the holding members 36 as shown in FIG. 9 (*c*), after lowering each stage 40 by the predetermined distance by the stage driving unit 41. Specifically, the holding member 36 on the right side is moved toward the holding member 36 on the left side. Thereafter, as shown in FIG. 9 (*d*), the stage 40 on the right side is moved in the direction approaching the stage 40 on the left side, and the portion of the storage bag 34 near the bottom thereof is sandwiched by each stage 40. It should be noted that when the holding member 36 on the right side is moved toward the holding member 36 on the left side so that the distance between the holding members 36 becomes small, instead of bringing each holding member 36 into contact with each other, a slight gap is formed between each holding member 36. Then, as shown in FIG. 9 (*e*), the stage driving unit 41 raises each stage 40 by a predetermined distance. Thereafter, as shown in FIG. 9 (*f*), by further moving the holding member 36 on the right side in the direction of approaching the holding member 36 on the left side, the portion of the storage bag 34 near the opening 34*p* thereof is sandwiched by each holding member 36. As a result, the opening 34*p* of the storage bag 34 is sealed by each bonding part 34*f* provided on the inner surface of the storage bag 34. As described above, two bonding parts 34*f* are provided on one inner surface of the main body 34*a* of the storage bag 34. Therefore, the opening 34*p* of the storage bag 34 is sealed by two bonding parts 34*f* (see FIG. 7). In this case, the opening 34*p* of the storage bag 34 can be more firmly sealed than when the opening 34*p* of the storage bag 34 is sealed with single bonding part 34*f*. As a result, it is possible to more reliably prevent the opening 34*p* of the storage bag 34 from being opened by a malicious third party and the banknotes are taken out from the storage bag 34.

After the opening 34*p* of the storage bag 34 is sealed, the biasing lever 39 is also moved to the left in FIG. 3 by the biasing lever driving unit 39*a*. As a result, the banknotes stored in the storage bag 34 are brought to one side (concretely, the left side) from the outside of the storage bag 34 by the biasing lever 39.

In the present embodiment, before raising each stage 40 by the predetermined distance, by moving the holding member 36 on the right side toward the holding member 36 on the left side so that the distance between the holding members 36 becomes small as shown in FIG. 9 (*c*), the tension of the opening portion of the storage bag 34 can be reduced. Thereby, when the stage 40 is raised by the predetermined distance, the state in which the end portion of the storage bag 34 hangs down is easily corrected. Further, since the distance between the holding members 36 is reduced, it is possible to prevent the banknotes from jumping out from the opening 34*p* of the storage bag 34 when each stage 40 is raised. Further, before each holding member 36 holds the portion of the storage bag 34 near the opening 34*p* thereof, the opening portion of the storage bag 34 is in a free state to some extent. Therefore, it is possible to reliably correct the state in which the end portion of the storage bag 34 hangs down when each stage 40 is raised by the predetermined distance. These matters will be described in detail below.

By storing the banknotes in the storage bag 34, the weight of the banknotes stored in the storage bag 34 is loaded to the portion of the storage bag 34 near the opening thereof. Therefore, there is a possibility that the both end portions of the storage bag 34 may hang down. If the end portion of the storage bag 34 hangs down as described above, there is a problem that sealing failure occurs when the opening 34*p* of the storage bag 34 is sealed by each bonding part 34*f* by sandwiching the portion of the storage bag 34 near the opening 34*p* thereof by each holding member 36. In contrast, in the present embodiment, before raising each stage 40 by the predetermined distance, as shown in FIG. 9 (*c*), the holding member 36 on the right side is moved toward the holding member 36 on the left side such that the distance between the holding members 36 becomes small to the extent that the storage bag 34 is not sandwiched between the holding members 36, and each stage 40 is raised by the predetermined distance as shown in FIG. 9 (*e*) before the portion of the storage bag 34 near the opening thereof is sandwiched between the holding members 36. These matters make it possible to prevent the hanging down of the end portion of the storage bag 34.

The controlling unit 50 further moves the holding member 36 on the right side in the direction of approaching the holding member 36 on the left side as shown in FIG. 9 (*f*), so that the portion of the storage bag 34 near the opening 34*p* thereof is sandwiched by each holding member 36. After the opening 34*p* of the storage bag 34 is sealed by each bonding part 34*f*, the controlling unit 50 raises each stage 40 further by a predetermined distance by the stage driving unit 41 as shown in FIG. 10 (*a*). After the opening 34*p* of the storage bag 34 is sealed by each bonding part 34*f*, by raising each stage 40, extra air inside the storage bag 34 can be removed. Therefore, the volume of the storage bag 34 can be reduced. After the storage bag 34 is taken out from the banknote storage mechanism 32 as will be described later, for example, the storage bag 34 is bound by a band and the like by the operator. If the extra air inside the storage bag 34 is removed and the volume of the storage bag 34 is reduced, it is possible to easily bind the storage bag 34 with the band and the like.

Thereafter, the controlling unit 50 further raises each stage 40 by a predetermined distance by the stage driving unit 41 as shown in FIG. 10 (*a*). Then, when each stage 40 reaches a position as shown in FIG. 10 (*b*), the portion to be the bottom part of the storage bag 34 when the banknotes are stored therein is thermally bonded and sealed by each heating member 42. The portion of the storage bag 34 thermally bonded and sealed by each heating member 42 is indicated by reference numeral 34*h* in FIG. 7. In this way, in the present embodiment, after the opening 34*p* of the storage bag 34 is sealed, the portion to be the bottom part of the storage bag 34 when the banknotes are stored therein is thermally bonded and sealed by each heating member 42. Therefore, even if some trouble occurs during the sealing process and then the sealing process is interrupted, it is possible to prevent the malicious third party from taking out the banknotes from the opening 34*p* of the storage bag 34. In the example shown in FIG. 7, one portion (one elongated region extending in the lateral direction) in the storage bag 34 is thermally bonded and sealed by each heating member 42, but it is not limited to such an example.

As another example, two or more portions (specifically, two or more laterally extending elongated regions) in the storage bag 34 may be thermally bonded and sealed by each heating member 42. In this case, it becomes possible to more firmly seal the portion to be the bottom part of the storage bag 34 when the banknotes are stored therein, as compared with the case where the portion to be thermally bonded and sealed by each heating member 42 is one (specifically, one elongated region extending in the lateral direction).

After the portion to be the bottom part of the storage bag 34 when the banknotes are stored therein is thermally bonded and sealed by each heating member 42, the stage driving unit 41 moves the stage 40 on the right side away from the stage 40 on the left side so that the stages 40 are separated from each other, as shown in FIG. 10 (*c*). Then, as shown in FIG. 10 (*d*), the holding member 36 on the right side is moved away from the holding member 36 on the left side. Thereafter, by removing the storage bag 34 from each holding member 36, the storage bag 34 can be taken out from the upper side of each holding member 36 of the banknote storage mechanism 32 in the upward direction.

As described above, according to the banknote handling apparatus 20 of the present embodiment, each heating member 42 is provided as a first bonding unit for thermally bonding and sealing the portion to be the bottom part of the storage bag 34 held by each holding member 36 when the banknotes are stored in the storage bag 34, and each holding member 36 is provided as a second bonding unit for bonding and sealing the opening 34*p* of the storage bag 34 held by each holding member 36 with the bonding material (more specifically, each bonding part 34*f*). In this manner, by thermally bonding and sealing the portion to be the bottom part of the storage bag 34 held by each holding member 36 when the banknotes are stored in the storage bag 34, it is possible to prevent generation of the empty space inside the storage bag 34. In addition, when the opening 34*p* of the storage bag 34 is bonded and sealed by the bonding material, compared to the case where the opening 34*p* of the storage bag 34 is sealed by being thermally bonded, it is easy to determine that opening 34*p* has been illegally opened and sealed again, so it is easy to determine such illegal act.

More specifically, in the case where only the opening 34*p* of the storage bag 34 is sealed and the portion to be the bottom part of the storage bag 34 when the banknotes are stored therein is not thermally bonded and sealed, there is a possibility that the empty space is generated inside the storage bag 34, depending on the storage amount of the banknotes. Further, in the case where the opening 34*p* of the storage bag 34 is thermally bonded and sealed, there is no trace that the opening 34*p* is opened in the storage bag 34 when the opening 34*p* has been opened and thermally sealed again. Therefore, there is a problem that, when opening 34*p* of the storage bag 34 is illegally opened, such an illegal act can not be determined. On the other hand, when the opening 34*p* of the storage bag 34 is bonded and sealed by the bonding material, even if the opening 34*p* is opened and then sealed again with the bonding material, a trace that the opening 34*p* was opened remains in storage bag 34. Therefore, when the opening 34*p* of the storage bag 34 is illegally opened, it is possible to determine such an illegal act.

Note that the banknote handling apparatus 20 and the banknote handling method (specifically, the method of the sealing process for sealing the opening 34*p* of the storage bag 34 held by each holding member 36) according to the present embodiment are not limited to the above-described aspects, and various modifications can be made.

For example, in the banknote handling apparatus 20 according to the present embodiment, the banknotes are stored in the storage bag 34 provided with the opening on one side in the banknote storage mechanism 32. However, the present embodiment is not limited to such an aspect. In the banknote handling apparatus according to the modified example, a cylindrical storage bag provided with openings at the upper part and the lower part respectively may be held by the holding unit and the banknotes may be stored in the storage bag held by the holding unit. Even in this case, the principle of the present invention can be applied to the banknote handling apparatus according to the modified example described above.

Further, in the banknote handling apparatus 20 according to the present embodiment, each bonding part 34*f* is provided near the opening 34*p* on one inner surface of the storage bag 34, and the opening 34*p* of the storage bag 34 is sealed by the bonding part 34*f*. However, the present embodiment is not limited to such an aspect. In the banknote handling apparatus according to the modified example, after the banknotes are stored in the storage bag, the bonding material may be applied to the portion near the opening on the inner surface of the storage bag before the portion near the opening of the storage bag is sandwiched by each holding member. In the banknote handling apparatus according to such a modified example, a coating mechanism (not shown) for applying the bonding material at the position near the opening on the inner surface of the storage bag is provided as the second bonding unit.

In addition, in the banknote storage mechanism 32 shown in FIG. 3 and the like, each holding member 36 is not provided with a heating member and the opening 34*p* of the storage bag 34 is not designed to be sealed by thermally bonding. However, the present embodiment is not limited to such an aspect. In another aspect of the present embodiment, a heating member for thermally bonding and sealing the opening 34*p* of the storage bag 34 may be provided in each holding member 36. A banknote storage mechanism 32*a* according to such a modified example will be described with reference to FIG. 11.

Figure 11:
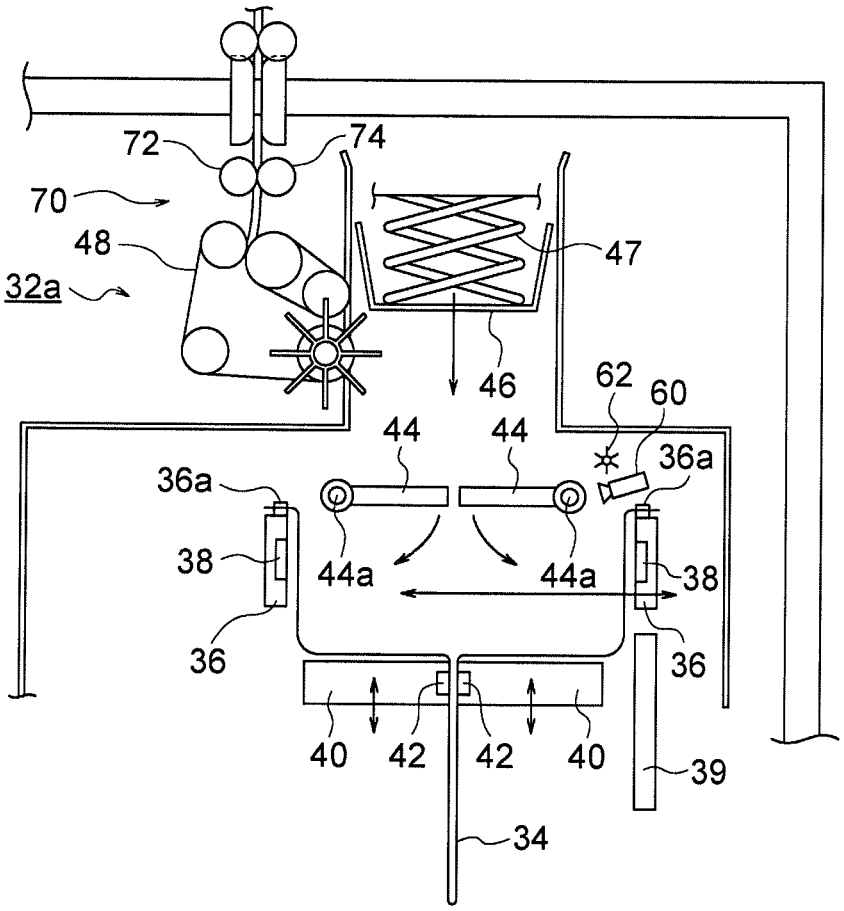
FIG. 11 is a side view showing a detail of a configuration of a banknote storage mechanism according to a modified example.

As shown in FIG. 11, in the banknote storage mechanism 32*a* according to the modified example, a heating member 38 is provided in each holding member 36. Then, after a predetermined amount of the banknotes are stored in the storage bag 34 held by each holding member 36 in the banknote storage mechanism 32, before the storage bag 34 is taken out from the banknote storage mechanism 32, one holding member 36 is moved toward the other holding member 36. Then, with these holding members 36 in contact with each other, the opening 34*p* of the storage bag 34 can be thermally sealed by applying heat to the portion of the storage bag 34 near the opening thereof by the heating member 38. In the banknote handling apparatus provided with the banknote storage mechanism 32*a* according to such a modified example, it can be selected whether to bond the opening 34*p* of the storage bag 34 by each bonding part 34*f* or thermally seal the opening 34*p* of the storage bag 34 by each heating member 38. For example, the operator can select by the operation/display unit 29. Then, when it is selected that the opening 34*p* of the storage bag 34 is thermally sealed by each heating member 38, before the portion to be the bottom part of the storage bag 34 when the banknotes are stored therein is thermally bonded and sealed by each heating member 42 in a state as shown in FIG. 10 (*b*), the opening 34*p* of the storage bag 34 is thermally sealed by each heating member 38. In the banknote storage mechanism 32*a* according to such a modified example, even when the storage bag not having the bonding part provided near opening is mounted on the banknote storage mechanism 32*a*, the opening of the storage bag can be thermally sealed.

In addition, it can be selected whether to bond the opening 34*p* of the storage bag 34 by each bonding part 34*f* or thermally seal the opening 34*p* of the storage bag 34 by each heating member 38, based on predetermined information. The predetermined information can be, for example, information on the storage bag 34 such as the type of the storage bag 34 or the presence or absence of the bonding part 34*f*.

Furthermore, the opening 34*p* of the storage bag 34 may be bonded by each bonding part 34*f* and further thermally sealed by each heating member 38. For this purpose, it is preferable that the position where each bonding part 34*f* of the opening 34*p* of the storage bag 34 is provided and the position where the heating member 38 contacts are shifted from each other. In the banknote storage mechanism 32*a* according to such a modified example, the opening of the storage bag can be more firmly sealed, so that unauthorized opening can be reliably prevented.

Figure 7:
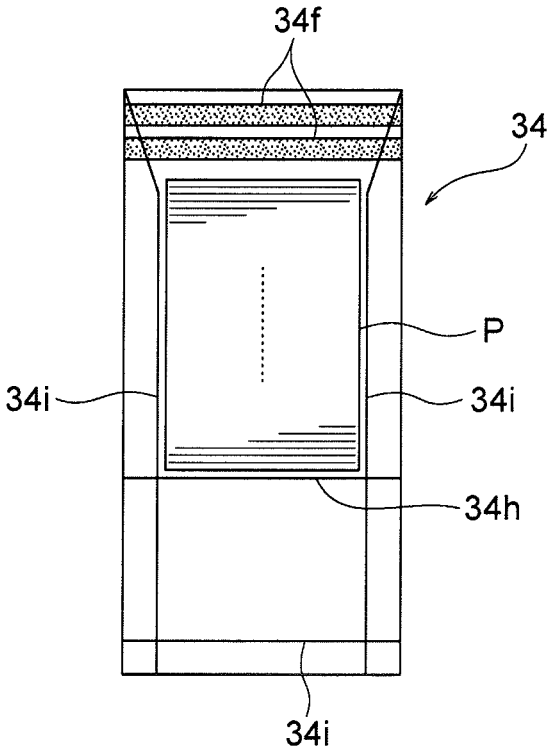
Figure 12:
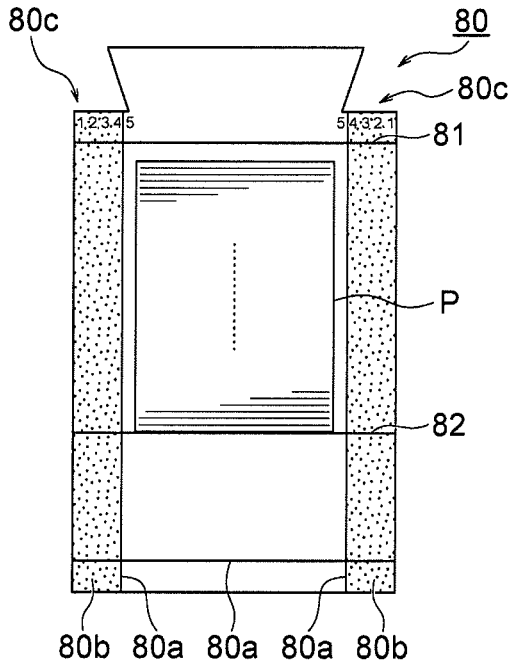

In this embodiment, the storage bag in which the plurality of banknotes are stored in a stacked state in the banknote storage mechanism 32 and the like is not limited to one having a structure as shown in FIGS. 5 and 7. In the banknote storage mechanism 32 and the like, the storage bag shown in FIG. 12 may be used as the storage bag in which the plurality of banknotes are stored in a stacked state. A storage bag 80 shown in FIG. 12 is formed by thermally bonding and sealing the portions near the both side edges and the bottom portion (that is, the portions indicated by reference numbers 80*a* in FIG. 12) respectively, after overlapping two films of substantially rectangular shape. In the storage bag 80 shown in FIG. 12, a large space (that is, a region 80*b* indicated by dots in FIG. 12) outside a thermally sealed portion 80*a* near the both side edges is gained. Specifically, the width of the region 80*b* outside the thermally sealed portion 80*a* near the both side edges in the storage bag 80 is set to a size within the range of 10 mm to 50 mm. In the storage bag 80 shown in FIG. 12, scales or characters are printed on an end portion 80*c* near the opening.

In the case of using such a storage bag 80, after the banknotes are stored and a portion 81 near the opening and a portion 82 serving as the bottom portion are respectively sealed, even when the thermally sealed portion 80*a* at the side edge of the storage bag 80 is longitudinally cut by a cutter and the like and the banknotes are taken out from the side edge by the malicious third party, such an illegal act can be easily found. More specifically, when the thermally sealed portion 80*a* at one side edge of the storage bag 80 is longitudinally cut, since the region 80*b* outside the thermally sealed portion 80*a* near the both side edges is formed large, the left and right lengths of the width of the region 80*b* become different. Specifically, when the storage bag 80 is bent in half at the center position in the width direction, it becomes asymmetric. Therefore, it can be easily found that the thermally sealed portion 80*a* at the side edge of the storage bag 80 is longitudinally cut. In addition, when the thermally sealed portion 80*a* at one side edge of the storage bag 80 is longitudinally cut, the scales or characters printed on the end portion 80*c* near the opening are missed. This makes it possible to be easily found that the thermally sealed portion 80*a* at the side edge of the storage bag 80 is longitudinally cut.

In the storage bag 80 shown in FIG. 12, the region 80*b* outside the thermally sealed portion 80*a* near both side edges may be colored. In this case, when the thermally sealed portion 80*a* at one side edge of the storage bag 80 is longitudinally cut, the size of the colored region 80*b* is different on the left and right. This makes it possible to be easily found that the thermally sealed portion 80*a* at the side edge of the storage bag 80 is longitudinally cut.

In the present embodiment, as shown in FIG. 10 (*a*), after the portion of the storage bag 34 near the opening 34*p* thereof is sandwiched between the holding members 36 and the opening 34*p* of the storage bag 34 is sealed by the respective bonding part 34*f*, the portion of the storage bag 34 near the lower end thereof may be fixed or pulled downward when each stage 40 is raised by the predetermined distance by the stage driving unit 41. Such technical matters will be described with reference to FIGS. 13 (*a*) to (*c*).

Figure 13:
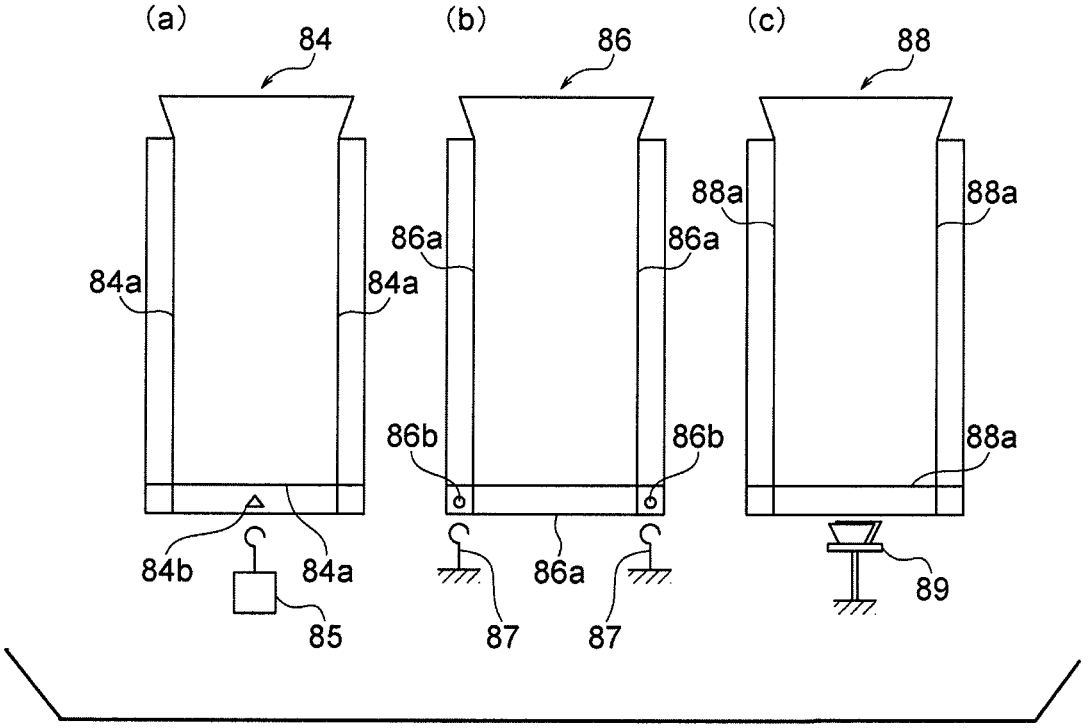

A storage bag 84 shown in FIG. 13 (*a*) is formed by thermally bonding and sealing the portions near the both side edges and the bottom portion (that is, the portions indicated by reference numbers 84*a* in FIG. 13 (*a*)) respectively, after overlapping two films of substantially rectangular shape. In addition, in the storage bag 84 shown in FIG. 13 (*a*), an opening 84*b* (hook hole) for hooking an weight 85 is provided near a lower end of the storage bag 84. In the case of sealing the opening provided in the upper part of such a storage bag 84, the operator initially hangs the weight 85 to the opening 84*b* of the storage bag 84 when the sealing process is performed. As a result, when each stage 40 is raised by the predetermined distance by the stage driving unit 41, the portion near the lower end of the storage bag 84 is pulled downward by the weight 85. Therefore, it is possible to prevent the storage bag 84 from loosening.

A storage bag 86 shown in FIG. 13 (*b*) is formed by thermally bonding and sealing the portions near the both side edges and the bottom portion (that is, the portions indicated by reference numbers 86*a* in FIG. 13 (*b*)) respectively, after overlapping two films of substantially rectangular shape. In the banknote storage mechanism, a pair of left and right hooks 87 is provided at a fixed position below the storage bag 86 held by each holding member. In addition, a pair of left and right openings 86*b* (hook holes) for being hooked by the respective hooks 87 are provided at the corners near the lower end of the storage bag 86. In the case of sealing the opening provided in the upper part of such a storage bag 86, the operator initially hooks the hooks 87 to the openings 86*b* of the storage bag 86 when the sealing process is performed. As a result, when each stage 40 is raised by the predetermined distance by the stage driving unit 41, the portion near the lower end of the storage bag 86 is fixed by each hook 87. Therefore, it is possible to prevent the storage bag 86 from loosening.

A storage bag 88 shown in FIG. 13 (*c*) is formed by thermally bonding and sealing the portions near the both side edges and the bottom portion (that is, the portions indicated by reference numbers 88*a* in FIG. 13 (*c*)) respectively, after overlapping two films of substantially rectangular shape. In the banknote storage mechanism, a clip 89 is provided at a fixed position below the storage bag 88 held by each holding member, and the portion near the lower end of the storage bag 88 is sandwiched between the clip 89. In the case of sealing the opening provided in the upper part of such a storage bag 88, the operator first clips the portion near the lower end of the storage bag 88 with the clip 89 when the sealing process is performed. As a result, when each stage 40 is raised by a predetermined distance by the stage driving unit 41, a portion near the lower end of the storage bag 86 is fixed by the clip 89. Therefore, it is possible to prevent the storage bag 86 from loosening.

Figure 14:
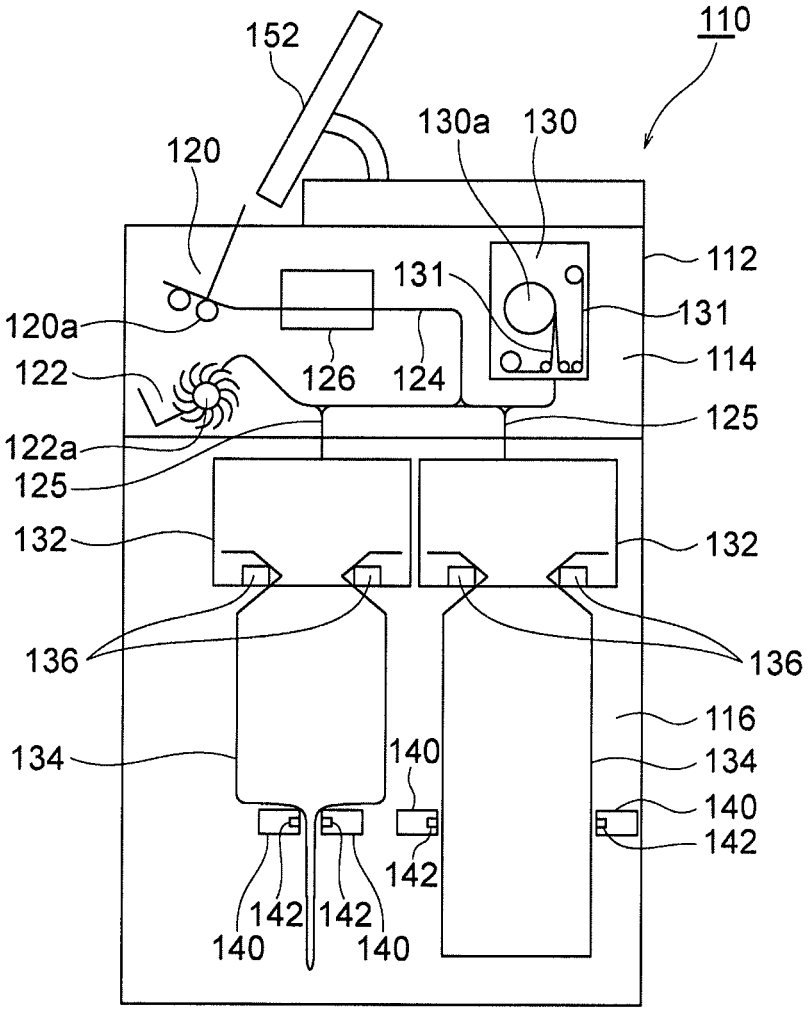
FIG. 14 is a side view showing another internal configuration of the banknote handling apparatus according to the embodiment of the present invention.

As a banknote handling apparatus, one having a structure as shown in FIG. 14 may be used. A banknote handling apparatus 110 shown in FIG. 14 is generally arranged in the sales floor or the back office floor of the store such as the supermarket, in the bank lobby or inside the bank, and the banknote handling apparatus 110 can perform various processes such as the depositing process of the banknotes. As shown in FIG. 14, the banknote handling apparatus 110 has a substantially rectangular parallelepiped housing 112. A left side surface of the housing 112 in FIG. 14 is a front surface of the housing 112 (that is, a surface on which the operator faces). Inside the housing 112, an upper assembly 114 and a lower assembly 116 are accommodated so as to be drawn forward (specifically, to the left in FIG. 14) from the front of the housing 112. In the upper assembly 114, an inlet unit 120 such as a receiving hopper and the like for putting the banknotes into the inside from the outside of the housing 112 is provided on the front upper part of the housing 112 (the upper part of the left side surface in FIG. 14). In the upper assembly 114, an ejecting unit 122 for ejecting the banknotes from the inside of the housing 112 to the outside is provided below the inlet unit 120 on the front surface (the face on the left side in FIG. 14) of the housing 112.

The inlet unit 120 is provided with a banknote feeding mechanism 120*a* for feeding out the banknotes, placed in the inlet unit 120 in a stacked state by the operator, one by one into the housing 112. In the upper assembly 114, inside the housing 112 of the banknote handling apparatus 110, there is provided a transporting unit 124 for transporting the banknotes one by one in the housing 112. The banknotes fed out from the inlet unit 120 by the banknote feeding mechanism 120*a* are transported one by one by the transporting unit 124. A recognition unit 126 is provided to the transporting unit 124, and a denomination, fitness, authenticity, and the like of each banknote transported by the transporting unit 124 is recognized by the recognition unit 126. Specifically, the recognition unit 126 includes an image sensor and the image sensor can capture the image of each banknote.

As shown in FIG. 14, the ejecting unit 122 is connected to the transporting unit 124, and the banknotes sent from the transporting unit 124 to the ejecting unit 122 are stacked in the ejecting unit 122. The ejecting unit 122 is accessible from the outside of the housing 112, and the operator can take out the banknotes stacked in the ejecting unit 122 from the front of the housing 112. A stacking wheel 122*a* is provided at the connection point with the ejecting unit 122 in the transporting unit 124, and the stacking wheel 122*a* rotates counterclockwise in FIG. 14. When the banknotes are sent from the transporting unit 124 to the ejecting unit 122, the stacking wheel 122*a* rotates in the counterclockwise direction in FIG. 14 in a state in which each banknote is sandwiched between the two blades in the stacking wheel 122*a*. As a result, each banknote sandwiched between the two blades of the stacking wheel 122*a* is stacked in an aligned state in the ejecting unit 122.

In the upper assembly 114, the transporting unit 124 is provided with a winding-type storage/feeding unit 130. The banknotes sent from the transporting unit 124 to the storage/feeding unit 130 are stored in the storage/feeding unit 130, and the banknotes stored in the storage/feeding unit 130 can be fed out one by one to the transporting unit 124. More specifically, the storage/feeding unit 130 has a drum 130*a* rotatable in both forward and reverse directions, and one end of each of a pair of strip-shaped winding members 131 is connected to the outer peripheral surface of the drum 130*a*. When the banknotes are sent from the transporting unit 124 to the storage/feeding unit 130, the banknotes are wound on the drum 130*a* one by one by the strip-shaped winding members 131. On the other hand, when each strip-shaped winding member 131 is rewound from the drum 130*a* by rotating the drum 130*a* in the reverse direction, the banknotes wound on the drum 130*a* are also released from each strip-shaped winding member 131 and fed out to the transporting unit 124.

As shown in FIG. 14, a plurality of banknote storage mechanisms 132 (for example, two banknote storage mechanisms 132) are provided in the lower assembly 116 for storing the banknotes inside each storage bag 134 provided with an opening. In each banknote storage mechanism 132, the storage bag 134 for storing the banknotes in a stacked state can be detachably mounted, and the banknotes sent from the transporting unit 124 to each banknote storage mechanism 132 are stored in the storage bag 134 in a stacked state. The storage bag 134 mounted on each banknote storage mechanism 132 of the banknote handling apparatus 110 shown in FIG. 14 has substantially the same configuration as the storage bag 34 as shown in FIGS. 5 and 7.

Each banknote storage mechanism 132 has substantially the same configuration as the banknote storage mechanism 32 shown in FIG. 3. Specifically, in each banknote storage mechanism 132, a pair of holding members 136 is provided so as to be separated from each other and opposed to each other. A portion of the storage bag 134 near the opening thereof is held by each holding member 136. One holding member 136 (specifically, the holding member 136 on the left side in FIG. 14, for example) is fixed in its position, and the other holding member 136 (specifically, the holding member 136 on the right side in FIG. 14, for example) can move toward the position-fixed holding member 136. In this manner, when one holding member 136 is moved toward the other holding member 136, the faces of the holding members 136 contact with each other. In the case where the release sheet is peeled off in the storage bag 134 and each of the bonding parts is exposed, when each holding member 136 comes into contact with each other, the opening of the storage bag 134 is sealed because each bonding part provided on one inner surface of the storage bags 134 bonds to the other inner surface of the storage bag 134.

In the banknote storage mechanism 132, there is provided a stage 140 on which at least a part of the storage bag 134 held by each holding member 136 is placed. The stage 140 is composed of a pair of right and left, and each stage 140 is movable in the vertical direction and the horizontal direction in FIG. 14. In addition, a part of the storage bag 134 held by each holding member 136 can extend downward from each stage 140 through the gap between the stages 140. Each stage 140 is provided with a heating member 142. Then, before the storage bag 134 is taken out from the banknote storage mechanism 132, when one stage 140 (for example, the stage 140 on the right side in FIG. 14) is moved toward the other stage 140 (for example, the stage 140 on the left side in FIG. 14) and these stages 140 are in contact with each other, heat is applied from each heating member 142 to a portion to be a bottom part of the storage bag 134 when the banknotes are stored therein, so that the bottom portion of the storage bag 134 is thermally bonded and sealed. Note that the position of the storage bag 134 which is thermally bonded and sealed by each heating member 142 varies depending on the storage amount of the banknotes in the storage bag 134.

In the upper assembly 114, a plurality (two in the example shown in FIG. 14) of branched transporting units 125 branches from the transporting unit 124 so as to correspond to each banknote storage mechanism 132. The banknotes branched from the transporting unit 124 to each branched transporting unit 125 are sent from this branched transporting unit 125 to the storage bag 134 mounted on each banknote storage mechanism 132 and stored in the storage bag 134.

Note that, a configuration to be described below may be used in the banknote handling apparatus 110 as shown in FIG. 14. Specifically, the opening of the storage bag 134 mounted on one banknote storage mechanism 132 of the two banknote storage mechanisms 132 may be sealed by the bonding part and the opening of the storage bag 134 mounted on the other banknote storage mechanism 132 may be thermally sealed. In this case, a heating member (not shown) is provided to each holding member 136 of one banknote storage mechanism 132. In this banknote storage mechanism 132, it is possible to select which banknote storage mechanism 132 to use, based on the condition for collecting the banknotes. That is, it is possible to select whether to collect the banknotes with the storage bag 134 whose opening is sealed by the bonding part, or to collect the banknotes with the storage bag 134 whose opening is thermally sealed. For example, when collecting the banknotes with the storage bag 134 whose opening is thermally sealed, the banknotes to be collected are stored in the storage bag 134 mounted on the banknote storage mechanism 132 provided with the heating member. Various conditions can be set as the condition for collecting the banknotes. For example, it may be determined whether or not to collect the banknotes with the storage bag 134 based on the destination of the storage bag 134 taken out from the banknote storage mechanism 132. In such a banknote handling apparatus 110, among the storage bags 134 in which banknotes are stored, the opening of the storage bag 134 carried to a financial institution such as the bank is sealed by the bonding part. On the other hand, when the storage bag 134 storing the banknotes is used in the store where the banknote handling apparatus 110 is installed, the opening of the storage bag 134 is thermally sealed. This is because, when the storage bag 134 storing the banknotes is carried to the financial institution such as the bank, if the opening of the storage bag 134 is illegally opened, it is desirable to be able to determine such illegal act. In addition, the condition for collecting the banknotes may be a condition concerning the carrier who carries the storage bag 134. Further, the condition for collecting the banknotes may be a condition regarding the number of the banknotes or the amount of money of the banknotes stored in the storage bag 134.

In the banknote handling apparatus 110 as shown in FIG. 14, the installation of each stage 140 in one banknote storage mechanism 132 among the two banknote storage mechanisms 132 may be omitted, and the bottom of the storage bag 134 held by each holding member 136 may hang downward due to its own weight. Alternatively, in one banknote storage mechanism 132 among the two banknote storage mechanisms 132, as shown by the banknote storage mechanism 132 on the right side in FIG. 14, each stage 140 may be maintained in a separated state even if the storage bag 134 is held by each holding member 136. In such a banknote storage mechanism 132, there is a possibility that the empty space is generated inside the storage bag 134. However, in the case where the storage bag 134 storing the banknotes is used in the store without being carried to the financial institution such as the bank, there is no problem even if the empty space is more or less generated inside the storage bag 134.

In the banknote handling apparatus 110 as shown in FIG. 14, in each of the two banknote storage mechanisms 132, the heating member (not shown) may be provided to each holding member 136. Then, in each banknote storage mechanism 132, the operator can select by an operation/display unit 152 whether the opening of the storage bag 134 is bonded by the bonding part such as the bonding material and the like or the opening of the storage bag 134 is thermally sealed by the heating member.

In addition, the paper sheet handling apparatus according to the present invention may handle paper sheets other than the banknotes (for example, checks, gift certificates, and the like). In other words, the principle of the present invention may also be applied to a case where the banknote storage mechanism 32 as shown in FIG. 3 and the like handles the paper sheets other than the banknotes. Even in this case, the portion to be the bottom part of the storage bag 34 when the banknotes are stored therein is thermally bonded and sealed, and the opening 34*p* of the storage bag 34 is bonded and sealed with the bonding material (specifically, for example, each bonding part 34*f*). This makes it possible to prevent the occurrence of the empty space inside the storage bag 34, and even if the opening 34*p* of the storage bag 34 is illegally opened, such an illegal act can be determined.

What is claimed is:

1. A paper sheet handling apparatus for storing a paper sheet inside a storage bag including a main body provided with an opening and a held portion provided near the opening of the main body, the paper sheet handling apparatus comprising:

a holding unit configured to hold the held portion of the storage bag;

a placement unit configured to be movable in a first direction in which the placement unit moves away from the holding unit and a second direction in which the placement unit approaches the holding unit and on which at least a part of the main body of the storage bag held by the holding unit is placed;

a first bonding unit configured to seal a first portion of the main body near a portion to be a bottom part of the storage bag held by the holding unit when the paper sheet is stored in the storage bag;

a second bonding unit configured to seal a second portion of the main body near the held part of the storage bag so as to close the opening of the storage bag held by the holding unit; and a control unit configured to control the apparatus, wherein the control unit is configured to control the apparatus to perform processes in an order of:

a first process in which the paper sheets are stored inside the storage bag being held by the holding unit;

a second process in which the placement unit on which the part of the storage bag storing the paper sheets therein is placed is moved in the first direction by a first distance;

a third process in which the placement unit on which the part of the storage bag storing the paper sheets therein is placed is moved in the second direction by a second distance;

a fourth process in which the second portion of the storage bag storing the paper sheets therein is sealed by the second bonding unit; and a fifth process in which the first portion of the storage bag storing the paper sheets therein is sealed by the first bonding unit.

2. The paper sheet handling apparatus according to claim 1, wherein the holding unit includes a pair of holding members configured to hold the held portion of the storage bag and at least one of the holding members is configured to be movable in a direction toward and away from the other holding member, and the placement unit includes a pair of stages between which the main body of the storage bag extends in the first direction, and at least one of the stages is configured to be movable in a direction toward and away from the other stage and be movable in the first direction and the second direction.

3. The paper sheet handling apparatus according to claim 2, wherein the control unit controls the apparatus to perform a seventh process in which at least one of the holding members is moved in the direction toward the other holding member to such an extent that the storage bag is not sandwiched between the holding members, between the second process and the third process.

4. The paper sheet handling apparatus according to claim 3, wherein the control unit controls the apparatus to perform an eighth process in which at least one of the holding members is moved in the direction toward the other holding member so that the storage bag is sandwiched between the holding members, between the second process and the third process and after the seventh process.

5. The paper sheet handling apparatus according to claim 1, wherein the first bonding unit is provided on the placement unit and is configured to thermally bond and seal the first portion of the main body.

6. The paper sheet handling apparatus according to claim 1, wherein the control unit controls the apparatus to perform a sixth process in which the placement unit on which the part of the storage bag storing the paper sheets therein is placed is moved in the second direction by a third distance between the fourth process and the fifth process.

7. The paper sheet handling apparatus according to claim 1, further comprising a temporary holding unit that is configured to temporarily hold a plurality of paper sheets in a stacked state, and the control unit controls the apparatus to perform the first process in which the paper sheets held by the temporary holding unit are stored in the storage bag being held by the holding unit, after a temporary holding process in which the paper sheets are temporarily hold by the temporary holding unit is performed.

8. The paper sheet handling apparatus according to claim 7, further comprising a pressing unit configured to push the held paper sheets toward the storage bag so as to store the paper sheets held by the temporary holding unit in the storage bag.

9. The paper sheet handling apparatus according to claim 1, wherein the storage bag further includes a bonding part provided on an inner surface of the main body near the held portion to seal the main body, and the bonding material is applied to the bonding part.

10. The paper sheet handling apparatus according to claim 9, wherein a release sheet for protecting the bonding part is removably pasted on the bonding part.

11. The paper sheet handling apparatus according to claim 9, wherein the bonding part visually indicates that the opening of the main body has been opened when the opening is opened after sealing the opening.

12. The paper sheet handling apparatus according to claim 9, wherein a plurality of bonding parts is provided on an inner surface of the storage bag near the opening thereof.

13. The paper sheet handling apparatus according to claim 9, wherein the control unit controls the apparatus to perform the fifth process when each holding member approaches and the portion of the storage bag near the opening thereof is sandwiched between the holding members.

14. The paper sheet handling apparatus according to claim 1, wherein the second bonding unit is provided at the holding unit.

15. The paper sheet handling apparatus according to claim 1, wherein the first direction and the second direction are vertical directions.

* * * * *